US011060809B2

(12) United States Patent
McCall

(10) Patent No.: US 11,060,809 B2
(45) Date of Patent: Jul. 13, 2021

(54) MULTICAL LOWER

(71) Applicant: Shannon Howard McCall, Laceys Spring, AL (US)

(72) Inventor: Shannon Howard McCall, Laceys Spring, AL (US)

( * ) Notice: Subject to any disclaimer, the term of this patent is extended or adjusted under 35 U.S.C. 154(b) by 0 days.

(21) Appl. No.: 16/571,517

(22) Filed: Sep. 16, 2019

(65) Prior Publication Data

US 2020/0166302 A1 May 28, 2020

Related U.S. Application Data

(60) Provisional application No. 62/731,336, filed on Sep. 14, 2018.

(51) Int. Cl.
*F41A 9/63* (2006.01)
*F41A 11/02* (2006.01)
*F41A 17/38* (2006.01)

(52) U.S. Cl.
CPC ..... *F41A 9/63* (2013.01); *F41A 11/02* (2013.01); *F41A 17/38* (2013.01)

(58) Field of Classification Search
CPC ..... F41A 11/02; F41A 9/63; F41A 17/38
USPC ..... 42/49.02
See application file for complete search history.

(56) References Cited

U.S. PATENT DOCUMENTS 1,365,743 A * 1/1921 Stokke ..... F41A 9/71 42/18
3,850,076 A * 11/1974 Atchisson ..... F41C 7/00 89/196
4,409,882 A * 10/1983 Blackshaw ..... F41A 5/04 89/163
5,900,577 A * 5/1999 Robinson ..... F41A 11/02 89/191.01
6,530,306 B1 * 3/2003 LaFleur ..... F41A 3/46 42/70.08
8,127,480 B1 * 3/2012 McManus ..... F41A 9/82 42/49.02
8,418,390 B1 * 4/2013 Wright ..... F41A 9/61 42/49.01
8,429,844 B2 * 4/2013 Dextraze ..... F41A 11/02 42/73
8,800,423 B1 * 8/2014 Lammers ..... F41A 5/18 89/191.01
10,101,101 B2 * 10/2018 Langevin ..... F41A 3/66
10,260,827 B2 * 4/2019 Mock ..... F41A 15/16
10,731,934 B2 * 8/2020 Song ..... F41A 3/66
2006/0150466 A1 * 7/2006 Hochstrate ..... F41A 19/45 42/69.03
2010/0229445 A1 * 9/2010 Patel ..... F41A 11/02 42/6
2013/0014418 A1 * 1/2013 Dextraze ..... F41A 29/00 42/16
2014/0331535 A1 * 11/2014 Robinson ..... F41A 3/66 42/6
2017/0292804 A1 * 10/2017 Lyren ..... F41A 17/066

* cited by examiner

*Primary Examiner* — John Cooper
(74) *Attorney, Agent, or Firm* — Bennet K. Langlotz; Langlotz Patent & Trademark Works, LLC

(57) ABSTRACT

A firearm is provided comprising a body which defines a magazine well. The well has a rear wall and a first side wall integrated with the body. A front wall is detachable from the body and in part defining the well. Further a second side wall is detachable from the body and in part defining the well.

1 Claim, 36 Drawing Sheets

MULTICAL LOWER

CROSS-REFERENCE TO RELATED APPLICATIONS

This application claims the benefit of U.S. Provisional Patent Application No. 62/731,336 filed on Sep. 14, 2018, entitled "Multical Lower", which is hereby incorporated by reference in its entirety for all that is taught and disclosed therein.

FIELD OF THE INVENTION

The present invention relates to a rifle, and more particularly, to a multi-caliber lower platform rifle.

BACKGROUND OF THE INVENTION

With the advantages associated with the ergonomics of the AR15/M16/AR10 platform rifles and the availability of the 7.62×39 round ammunition and AK47 variant box fed magazines around the world, a need exists for a rifle capable of capturing both the ergonomics of the AR15/M16/AR10 and the capability of firing the readily available 7.62×39 ammunition using AK47 variant box fed magazines. The limitations of the prior art are addressed by providing a firearm comprising a body which defines a magazine well. The well has a rear wall and a first side wall integrated with the body. A front wall is detachable from the body and in part defining the well. Further a second side wall is detachable from the body and in part defining the well.

DETAILED DESCRIPTION OF A PREFERRED EMBODIMENT

Figure 1:
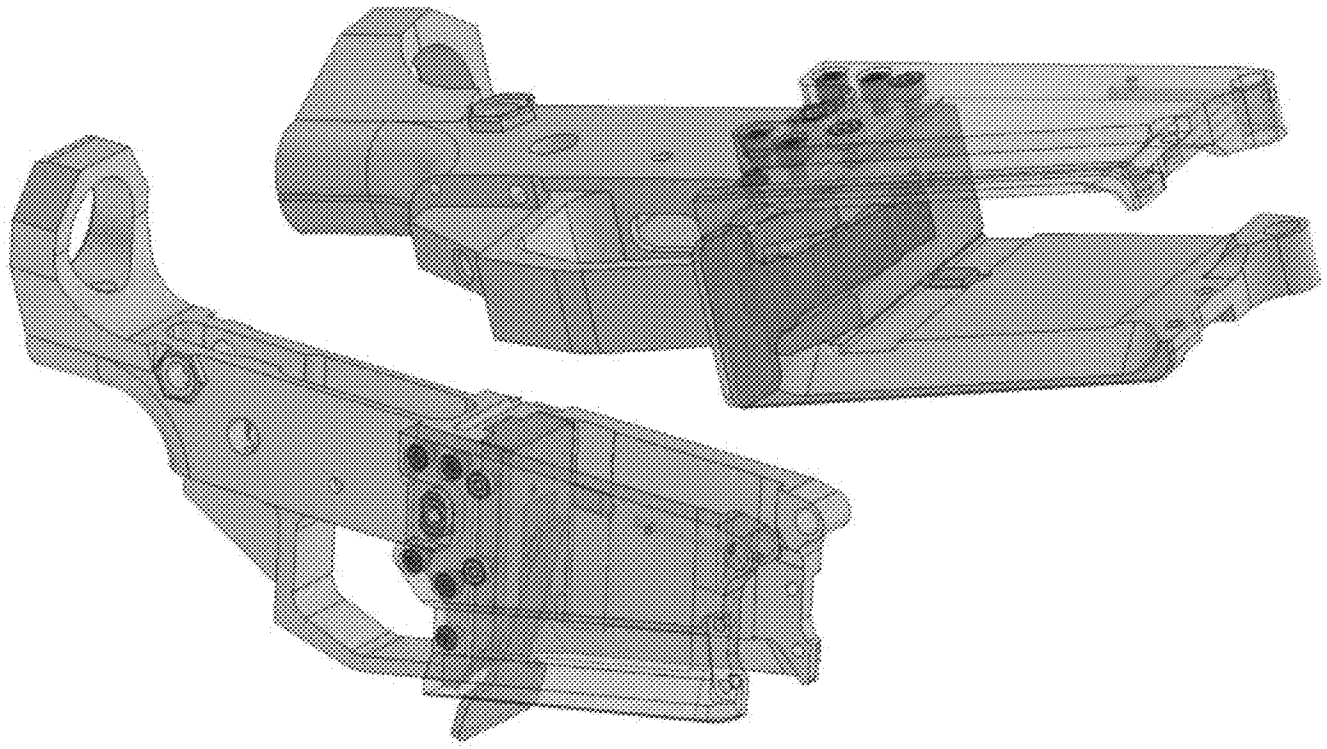
FIGS. 1-36 show various views of a preferred embodiment of the invention.

FIG. 1 illustrates the Multical converted into the AK 47 configuration:

Front magazine wall is removed to allow curved style AK47 style magazines.

Install AK mag block adapter

Figure 2:
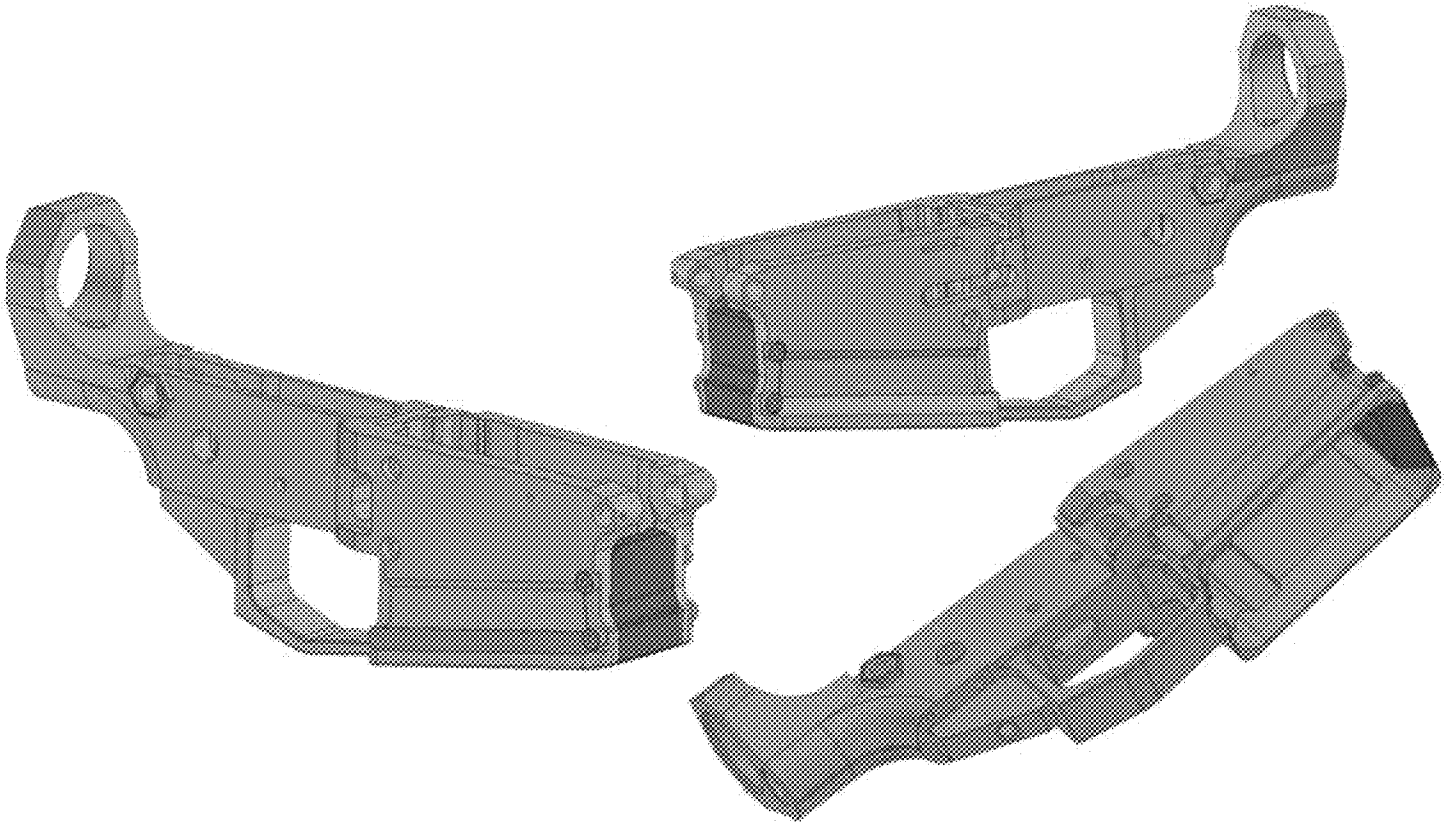

FIG. 2 illustrates the Multical converted into the 762/308 configuration:

Install the Front magazine wall

Remove the AK mag block adapter

Although the below described images are of a larger frame rifle, the same features and combinations have been designed in a smaller 556 size upper and lower and are currently in development all comparable options and features will be present in the smaller frame sizes as these features and options are scalable.

Figure 3:
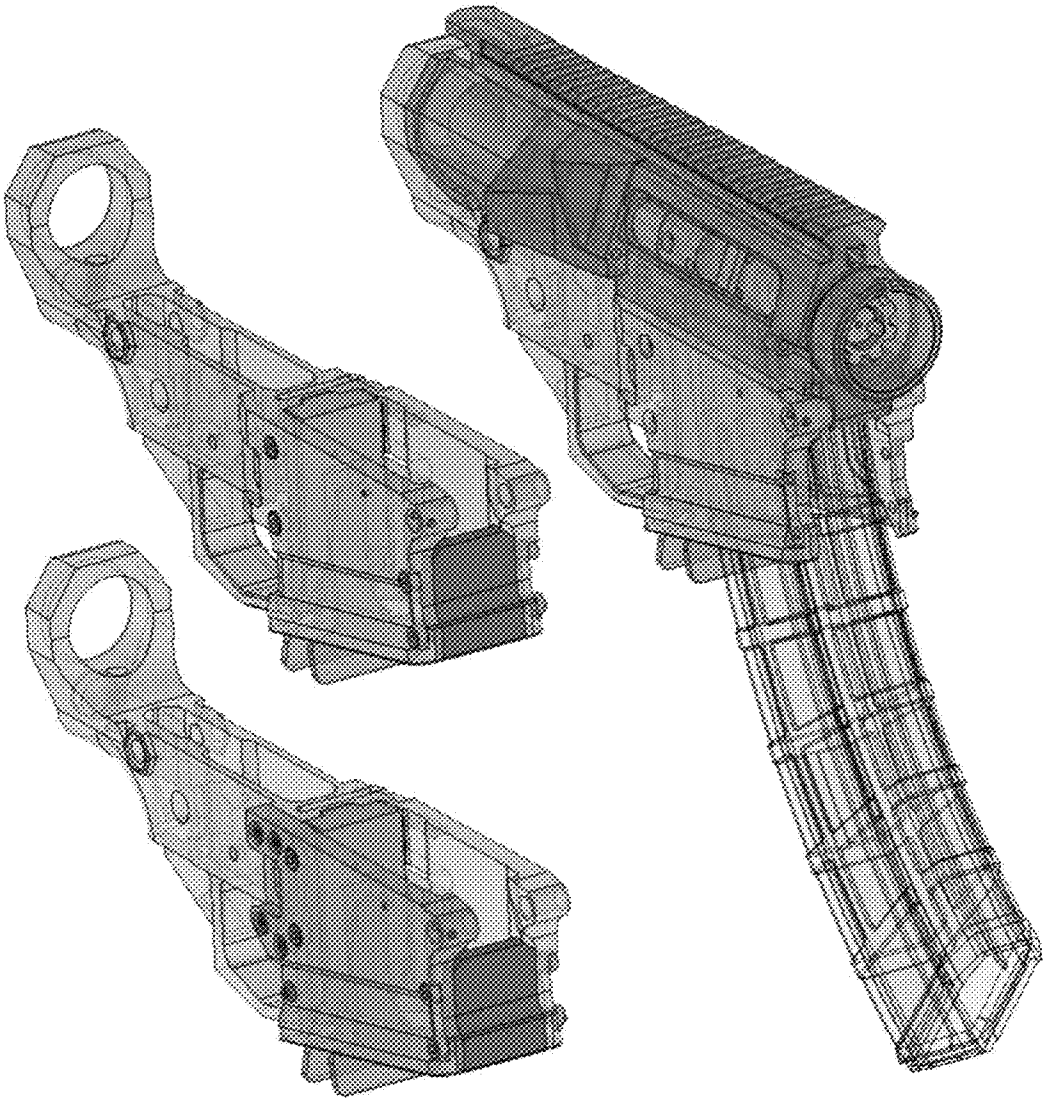

FIG. 3 illustrates a one-piece configuration (removable front wall for AK config) and a modular configuration (side plate and removable front wall for AK config).

Figure 4:
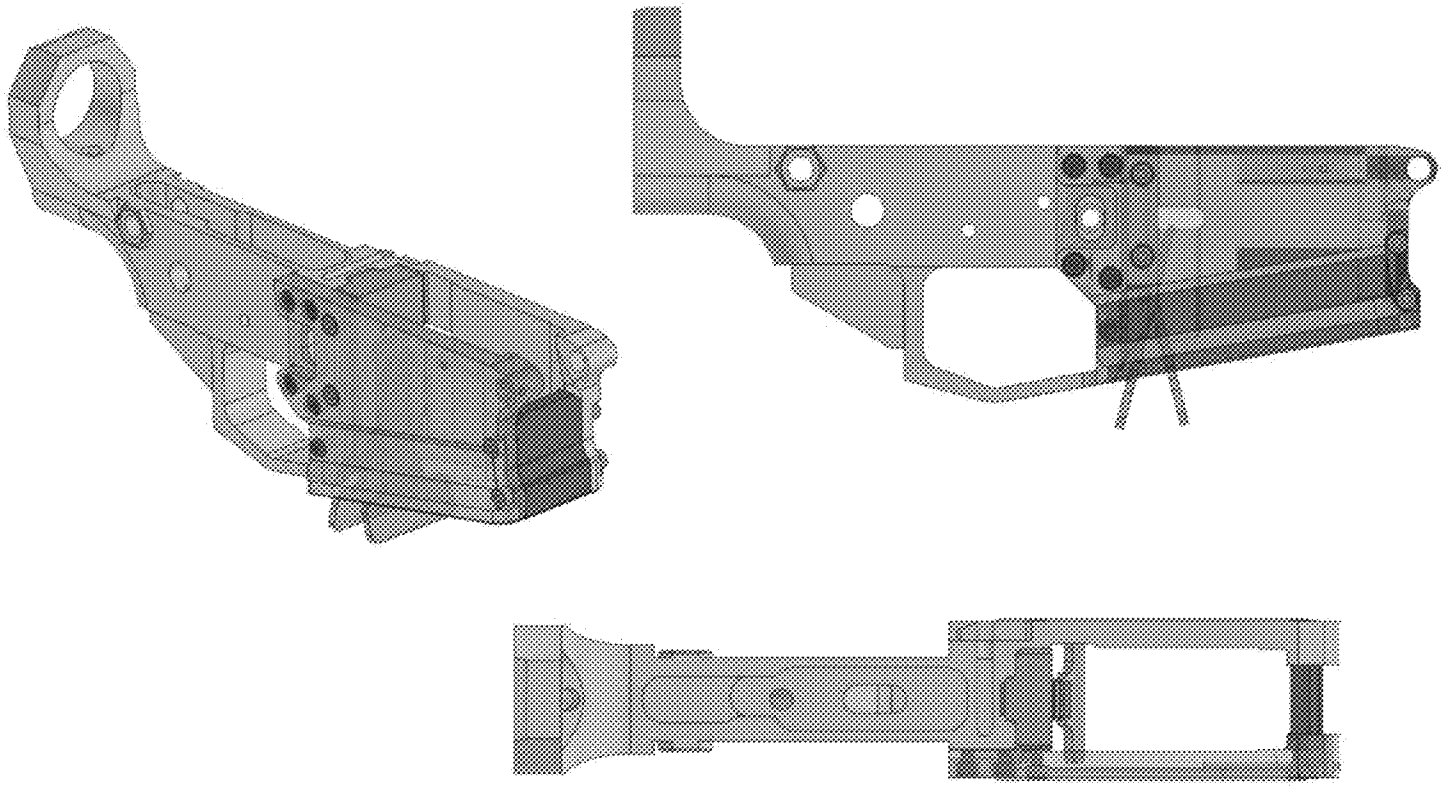

FIG. 4 shows a modular configuration (side plate and removable front wall for AK config) of M4K Multical Lower (all kit components installed).

Figure 5:
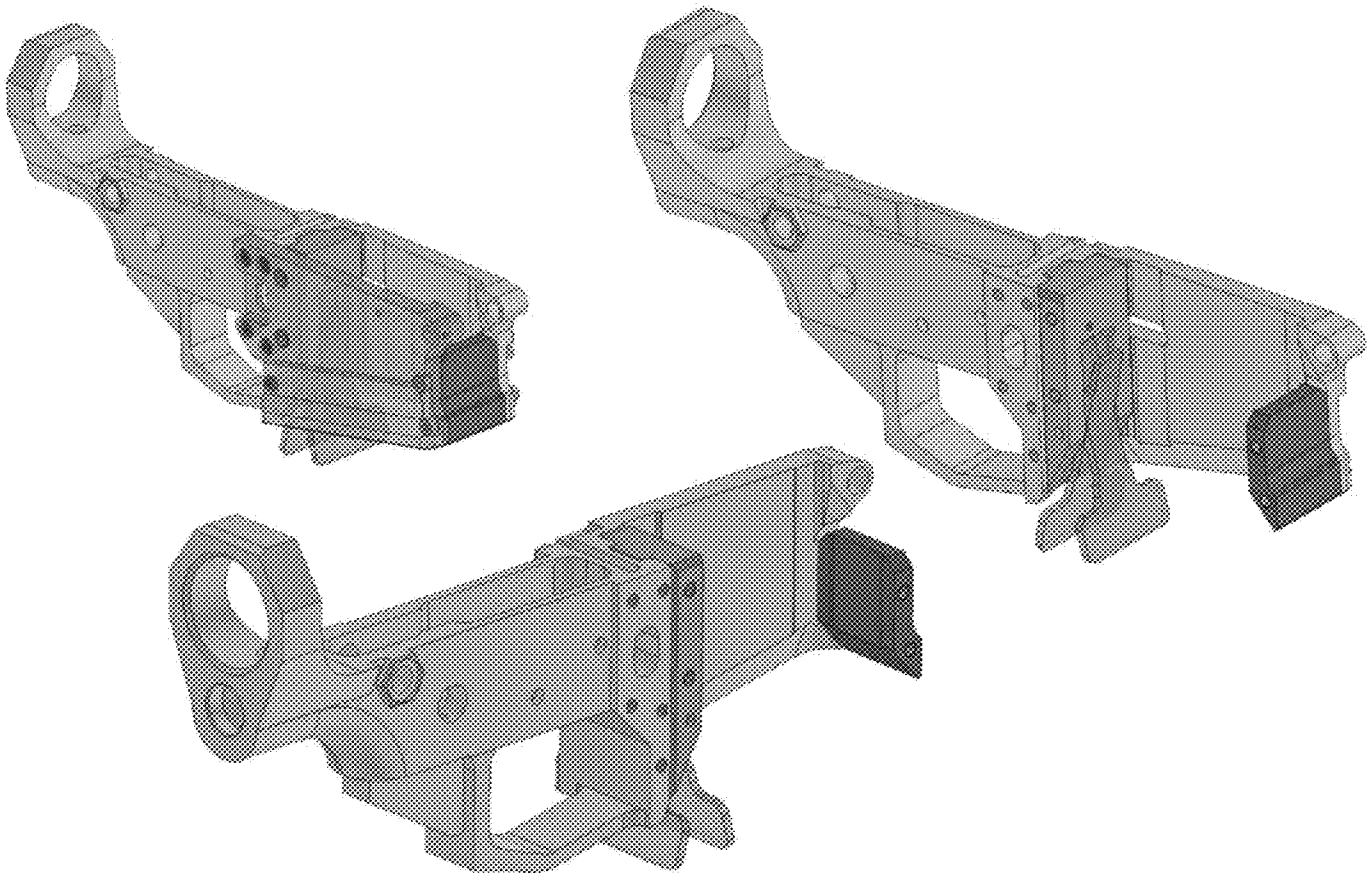

FIG. 5 shows a Modular Variation of M4K Multical Lower (side plate removed for clarity to show internal components).

Figure 6:
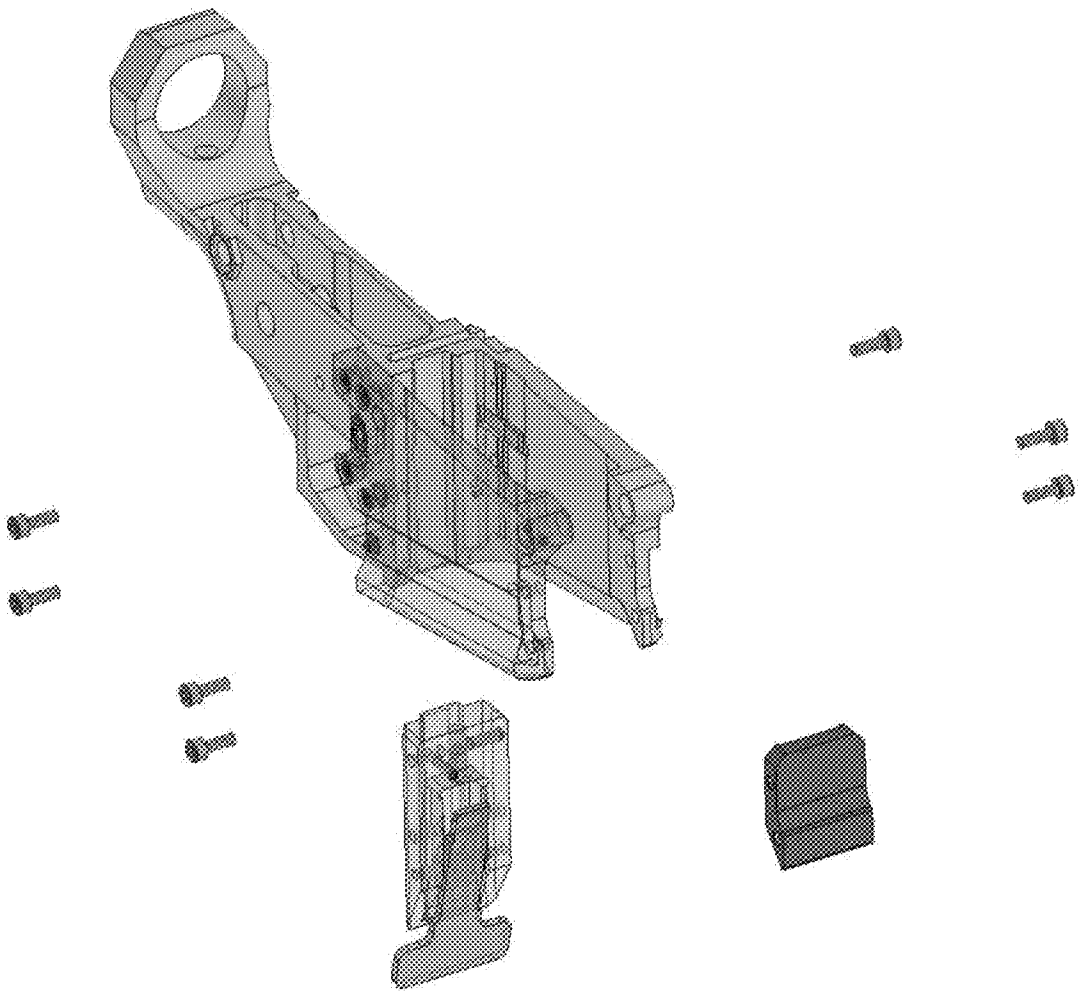

FIG. 6 shows a Modular Variation of M4K Multical Lower (Exploded view of multi cal conversion specific components).

Figure 7:
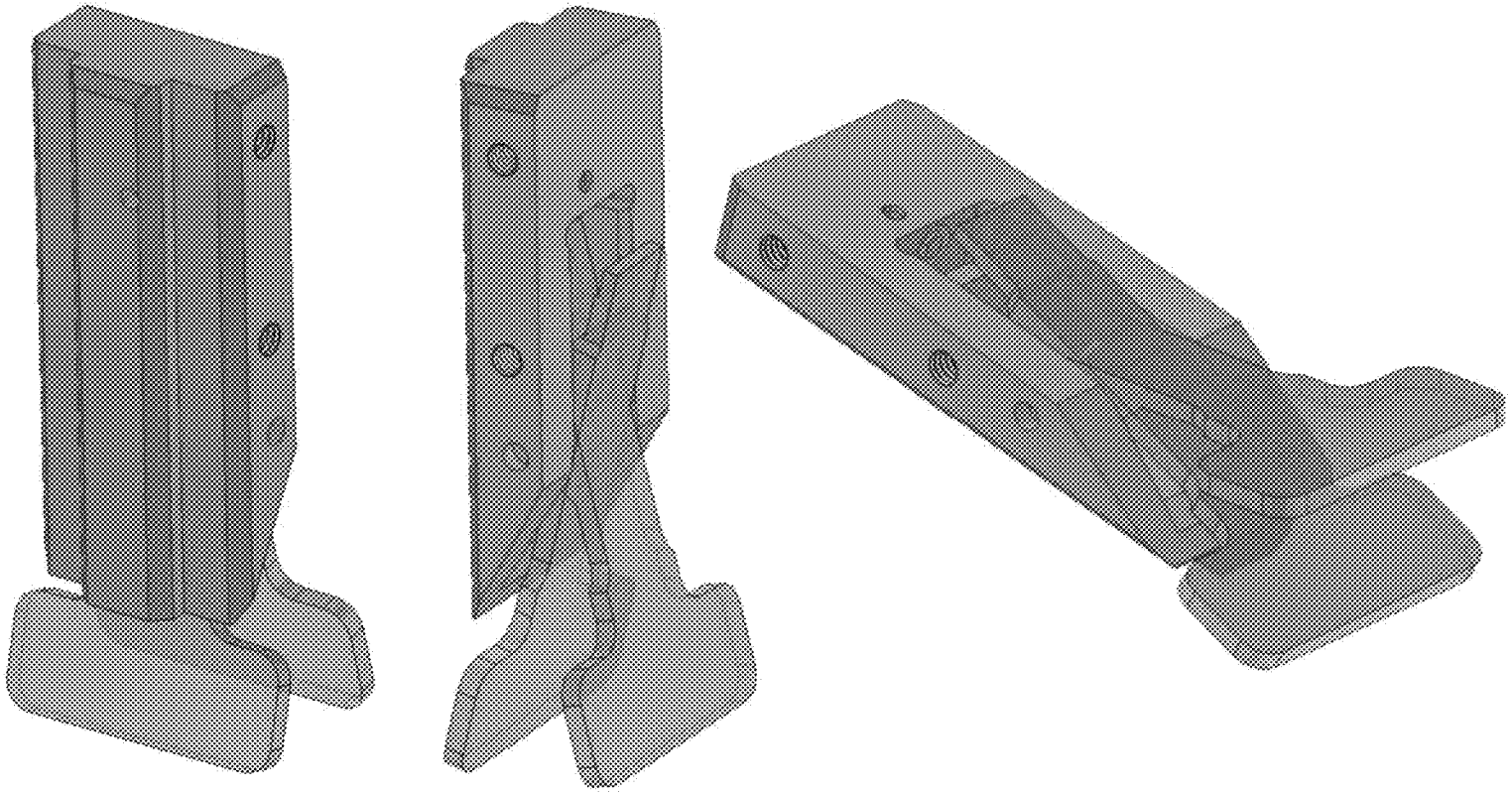

FIG. 7 shows a Multical Lower AK black magazine adapter.

Figure 8:
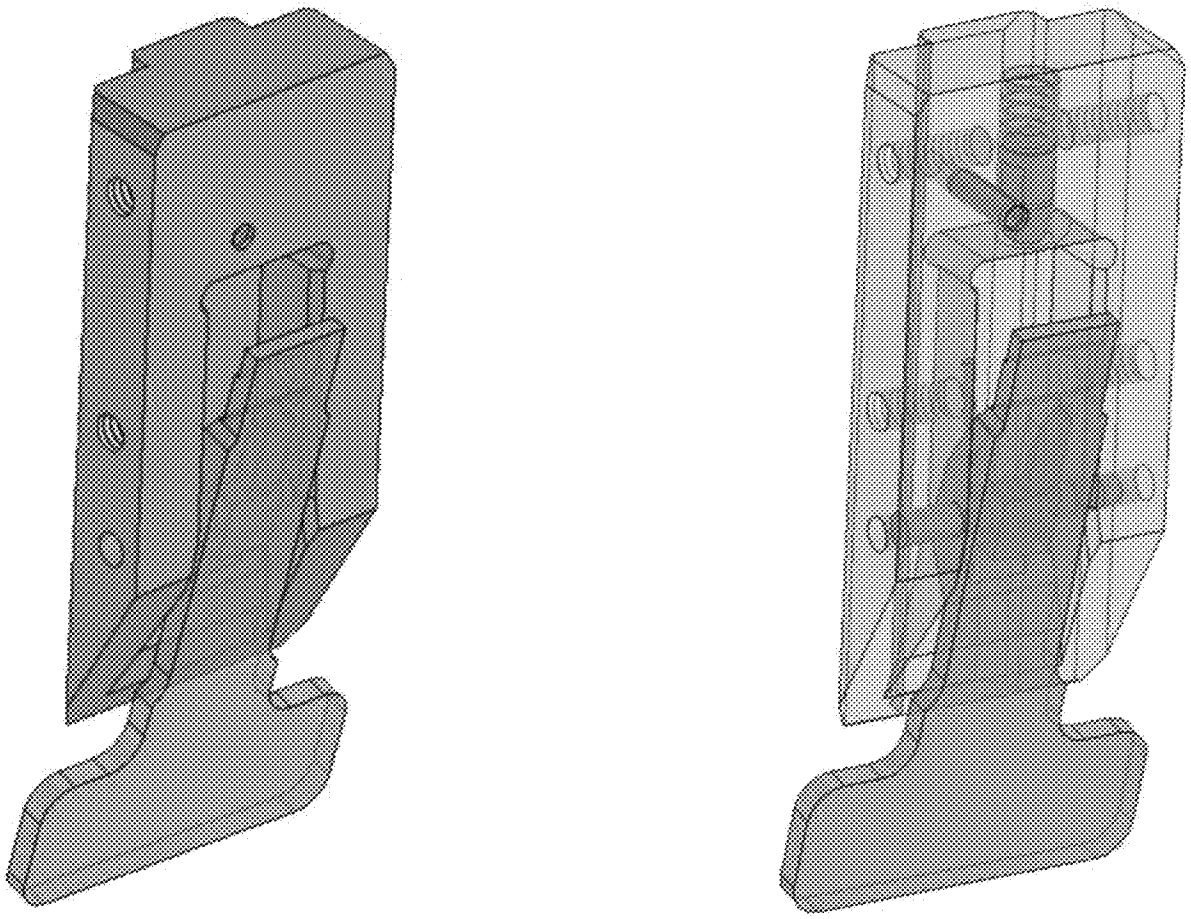

FIG. 8 shows a Multical Lower AK black magazine adapter.

Figure 9:
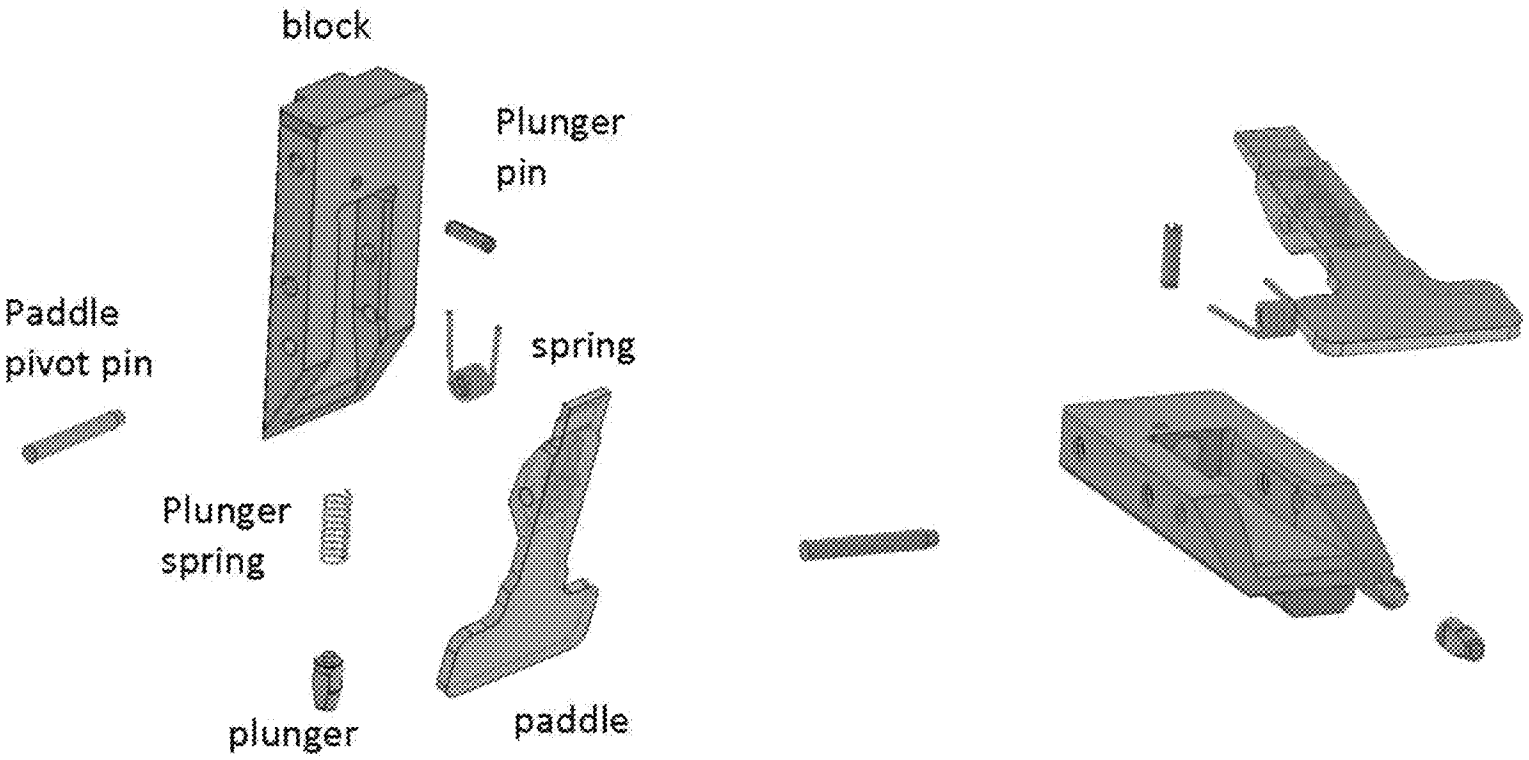

FIG. 9 shows a Multical Lower AK black magazine adapter.

Figure 10:
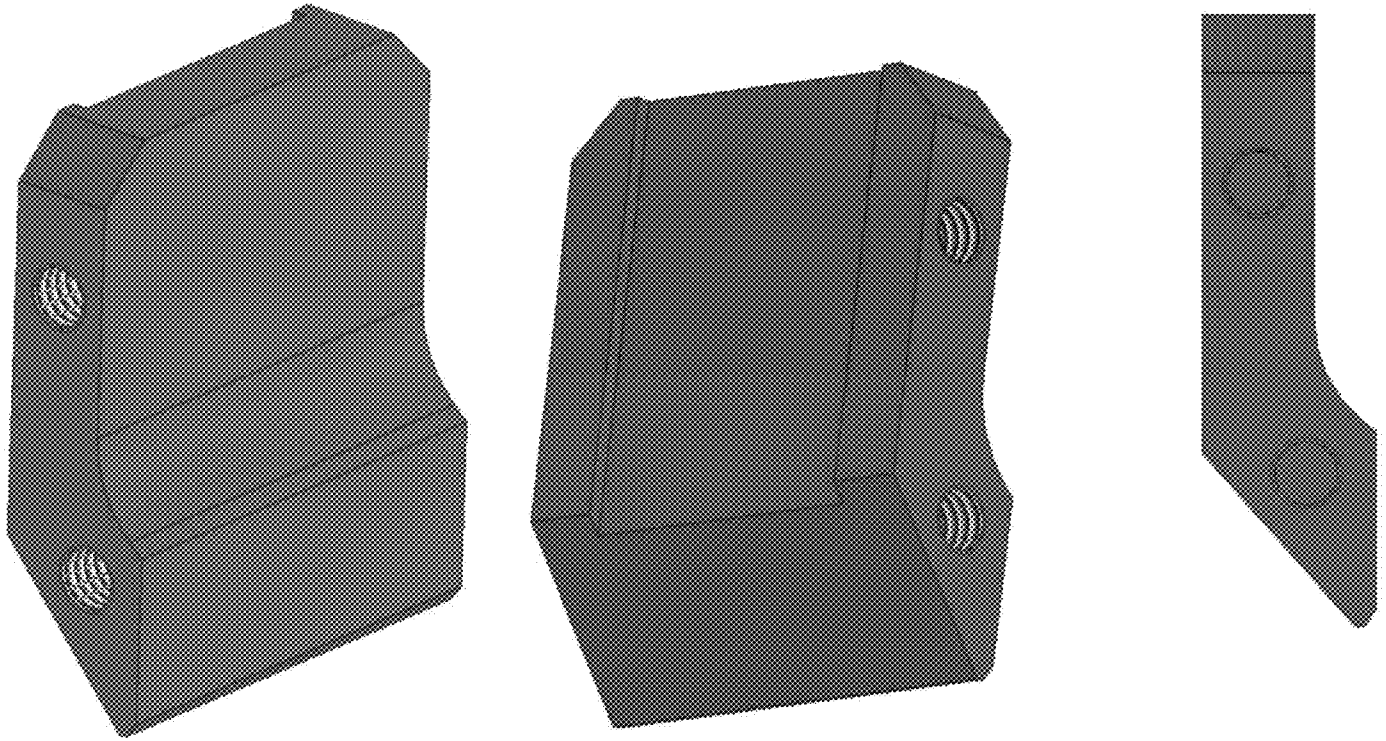

FIG. 10 shows a Multical front wall.

Figure 11:
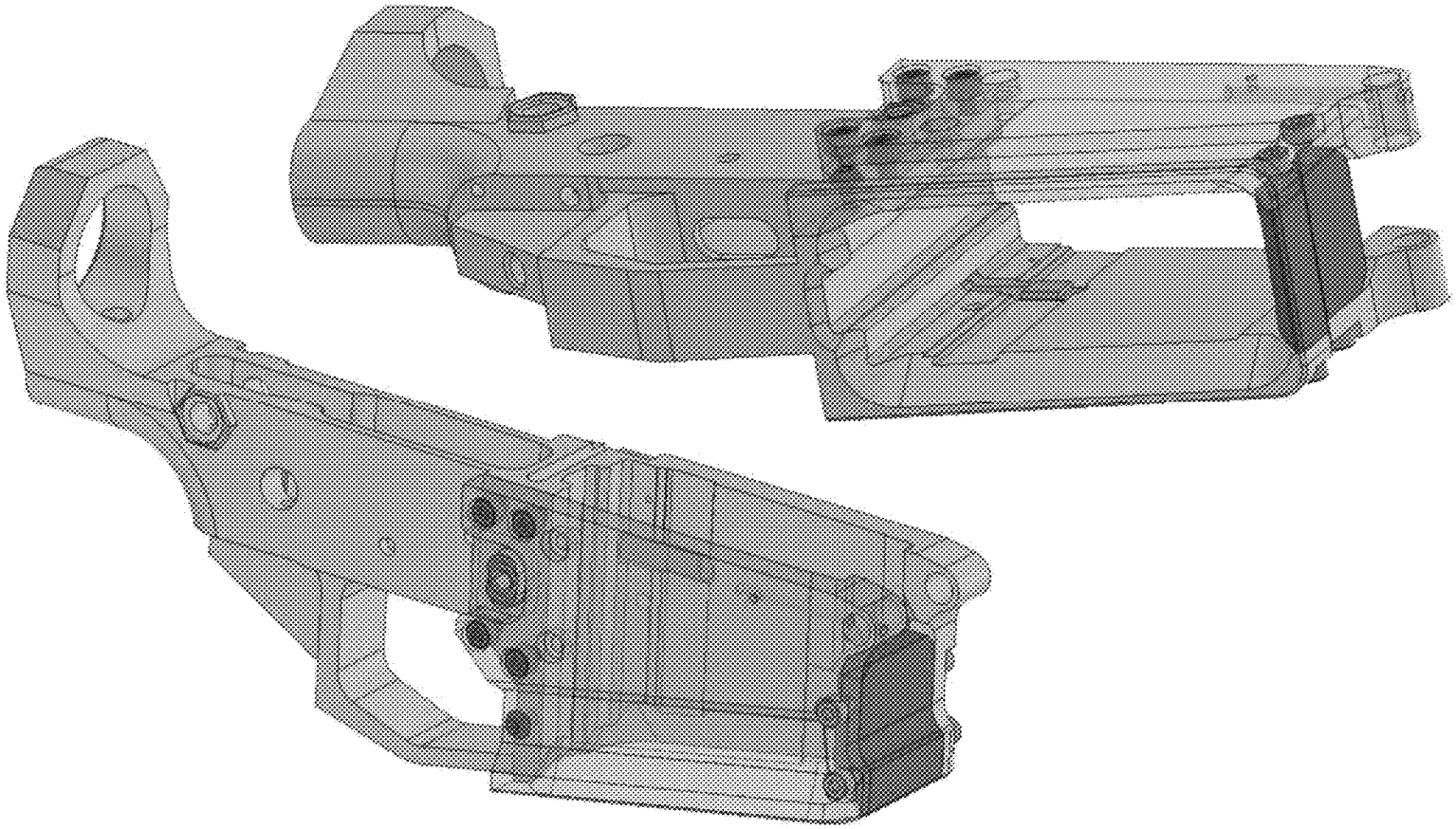

FIG. 11 illustrates a Multical Lower (76/65 Configuration). Shown in modular configuration (i.e., removable side plate) and M4K Multical Lower (762 Configuration i.e., front wall is installed, AK mag block removed).

Figure 12:
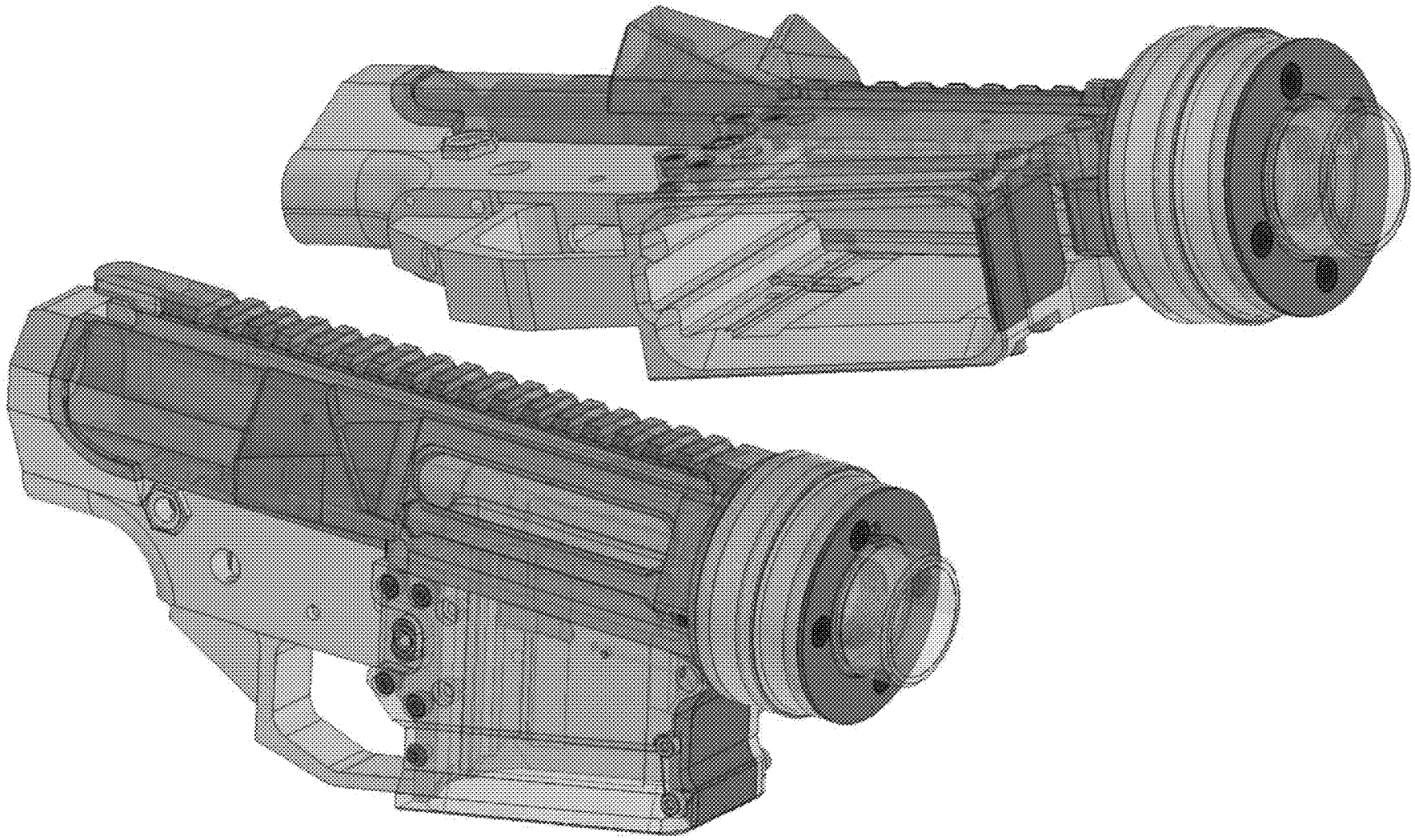

FIG. 12 illustrates a Multical Lower (76/65 Configuration). Shown in modular configuration (i.e., removable side plate) and M4K Multical Lower (762 Configuration i.e., front wall is installed, AK mag block removed).

Figure 13:
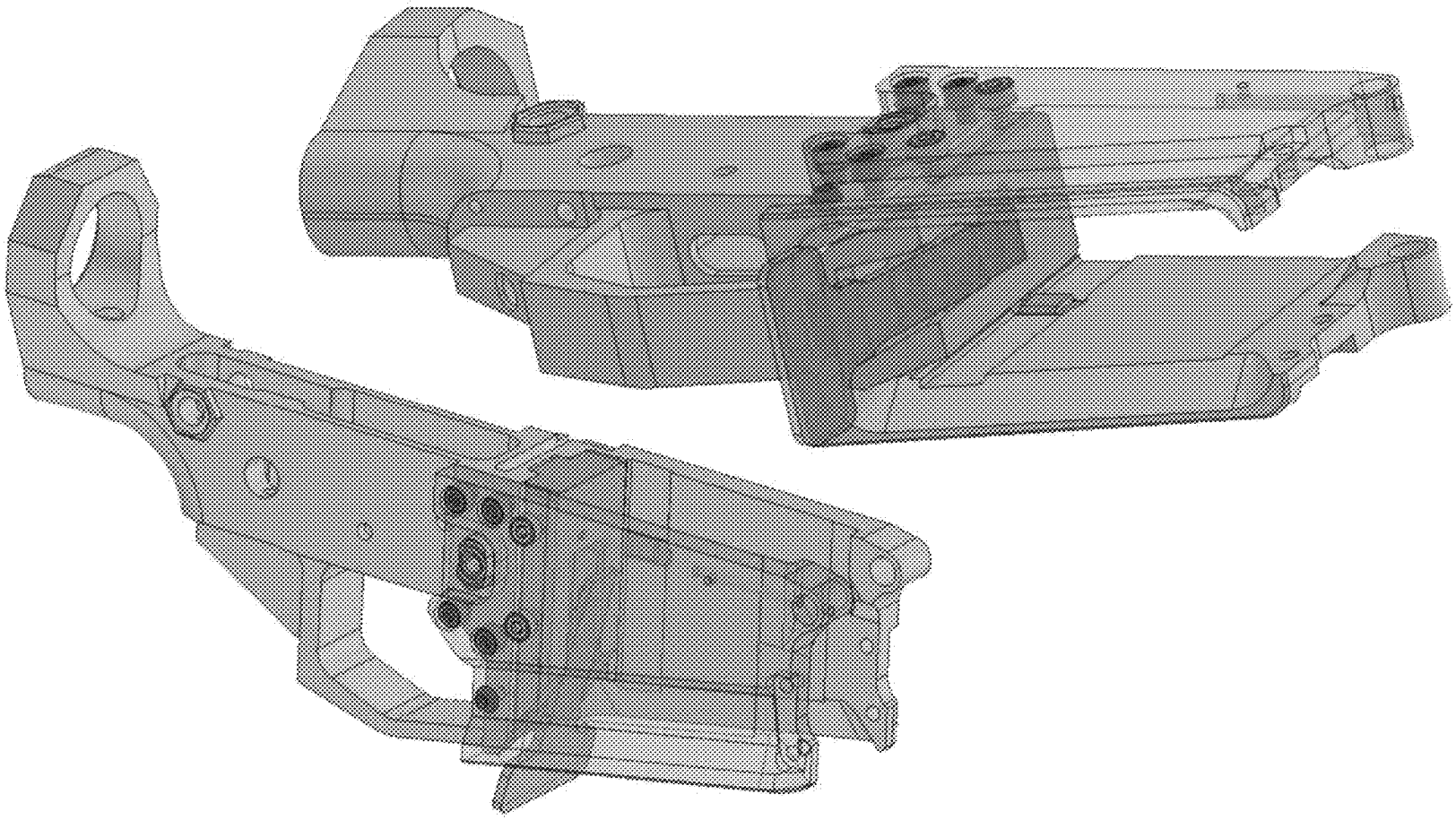

FIG. 13 illustrates a Multical Lower (AK47 Configuration). Shown in modular configuration (i.e., removable side plate) and M4K Multical Lower (AK47 Configuration i.e., front wall is removed, AK mag block installed).

Figure 14:
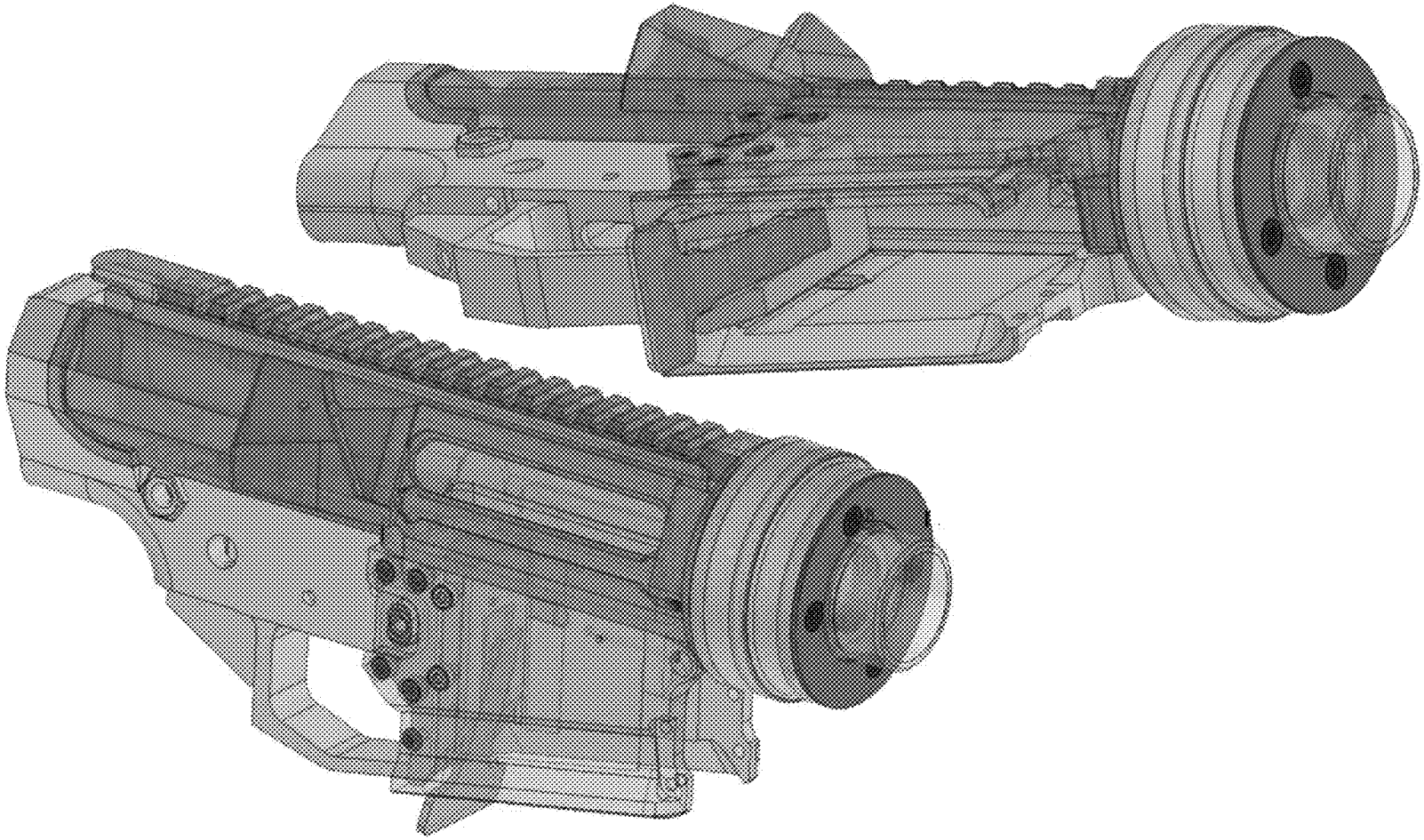

FIG. 14 illustrates a Multical Lower (AK47 Configuration). Shown in modular configuration (i.e., removable side plate) and M4K Multical Lower (AK47 Configuration i.e., front wall is removed, AK mag block installed).

Figure 15:
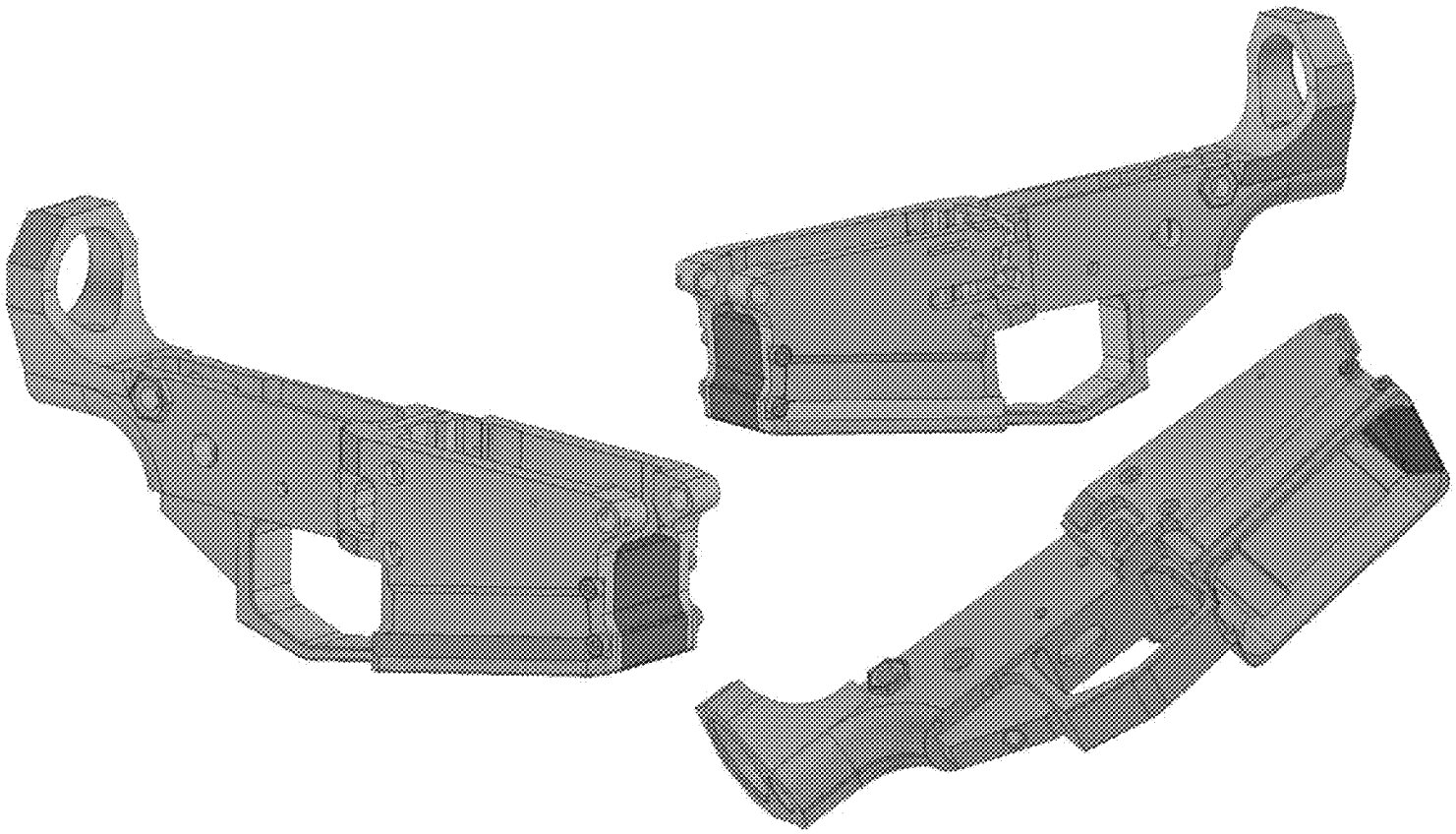

FIG. 15 illustrates a Multical Lower (76/65 Configuration). Shown in optional one piece configuration (i.e., no removable side plate) and M4K Multical Lower (762 Configuration i.e., front wall is installed, AK mag block removed).

Figure 16:
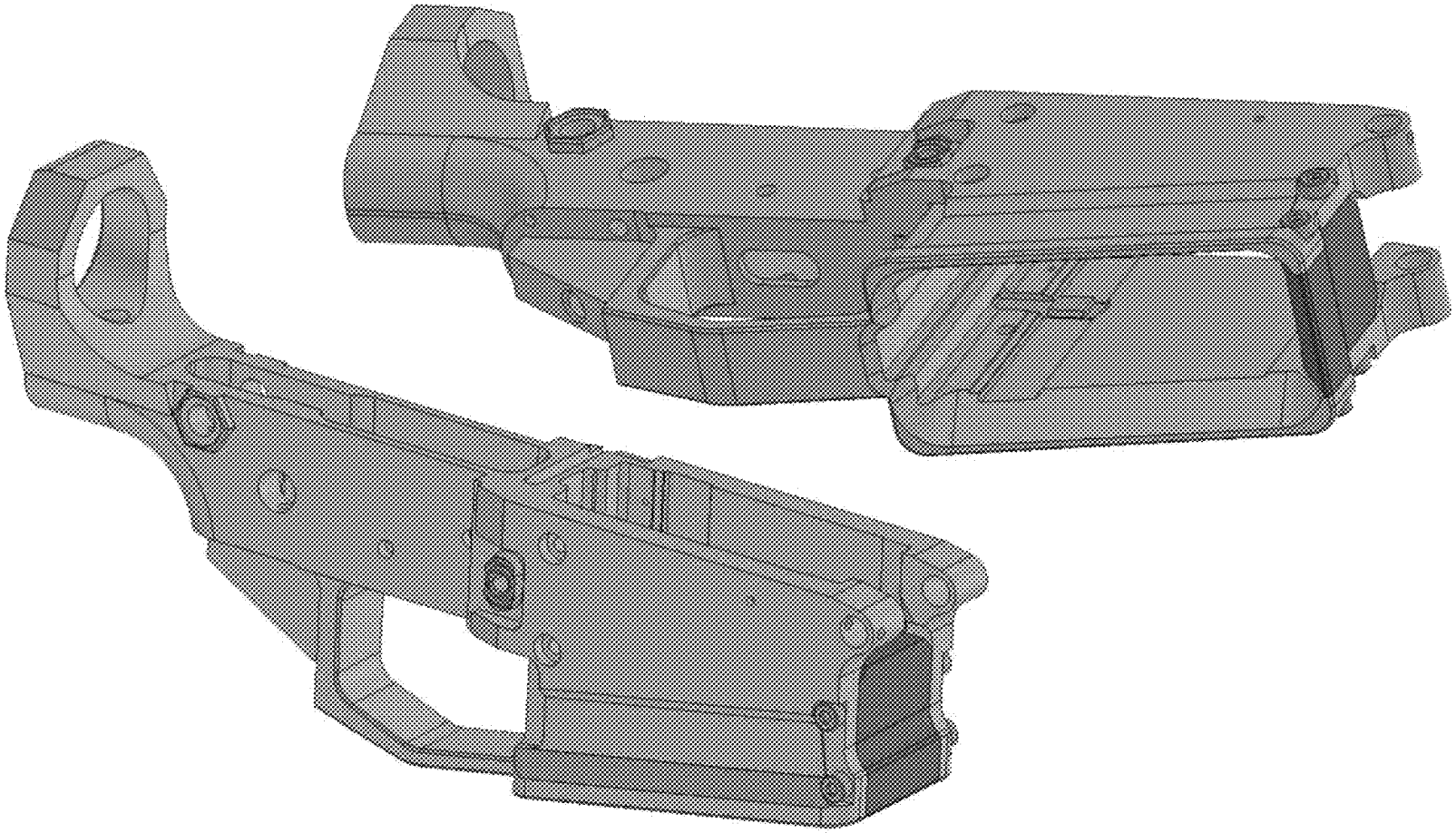

FIG. 16 illustrates a Multical Lower (76/65 Configuration); M4K Multical Lower (762 Configuration i.e., front wall is installed, AK mag block removed).

Figure 17:
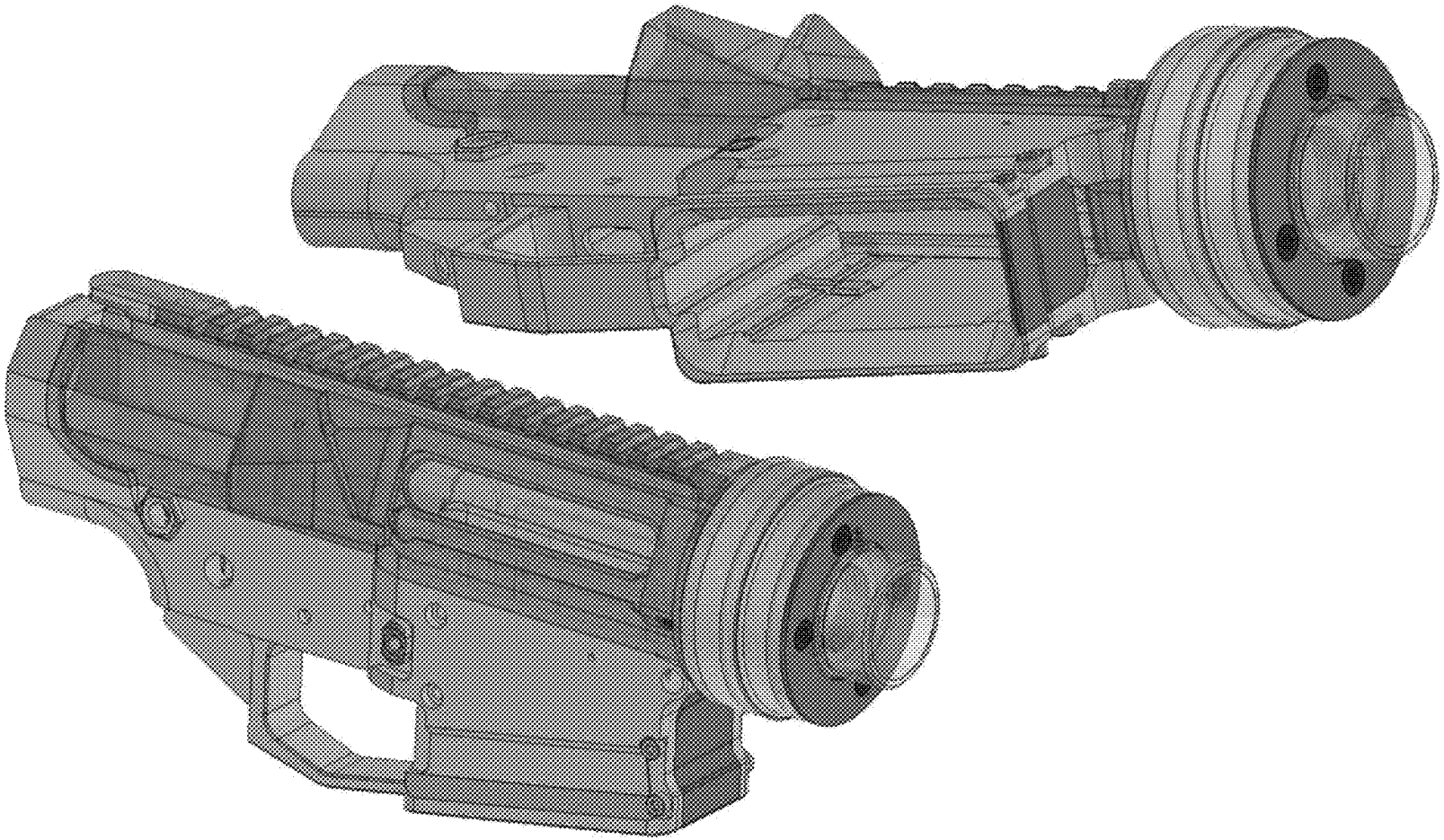

FIG. 17 illustrates a Multical Lower (76/65 Configuration); M4K Multical Lower (762 Configuration i.e., front wall is installed, AK mag block removed).

Figure 18:
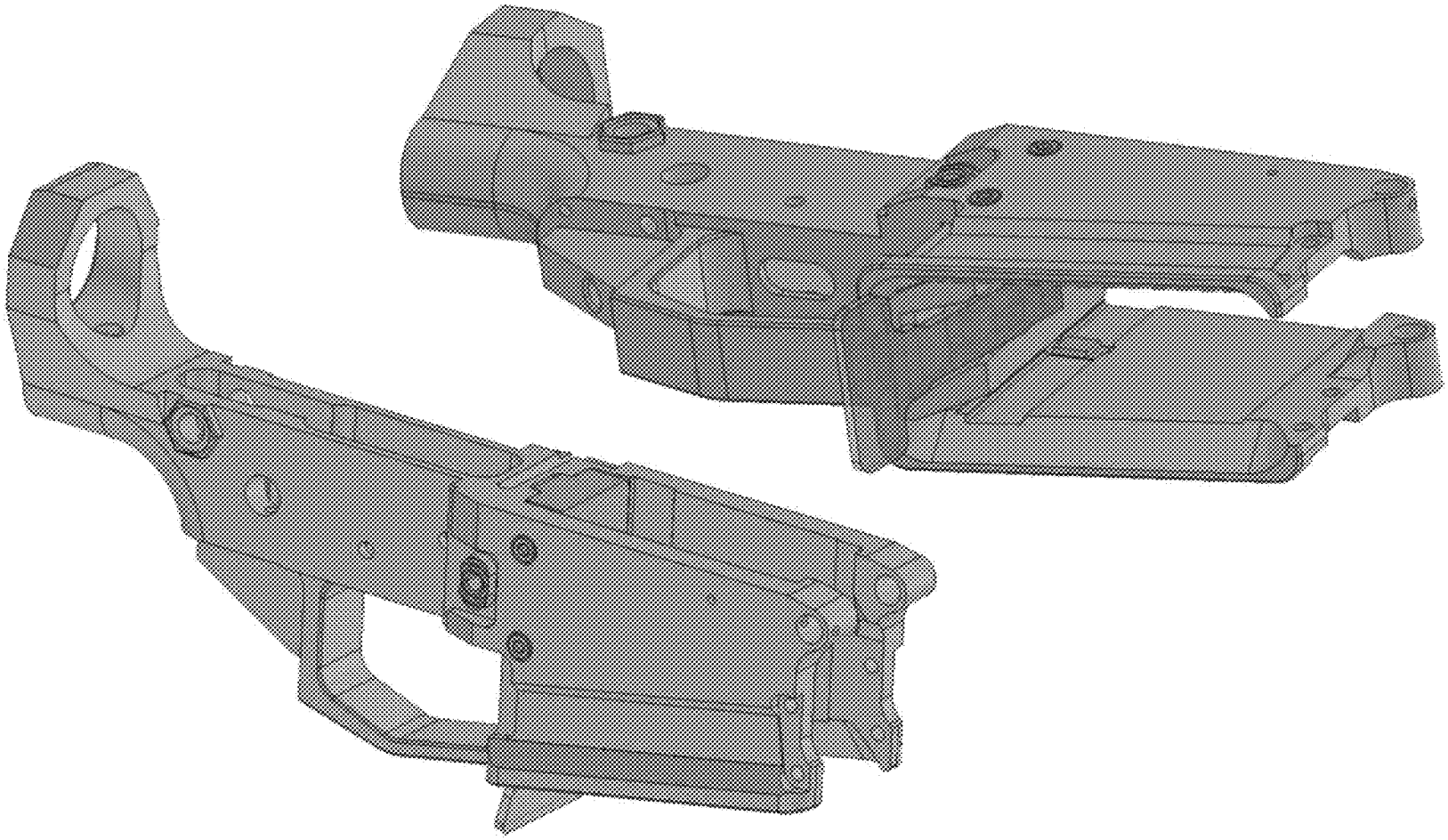

FIG. 18 shows a Multical Lower (AK47 Configuration); M4K Multical Lower (AK47 Configuration i.e., front wall is removed, AK mag block installed).

Figure 19:
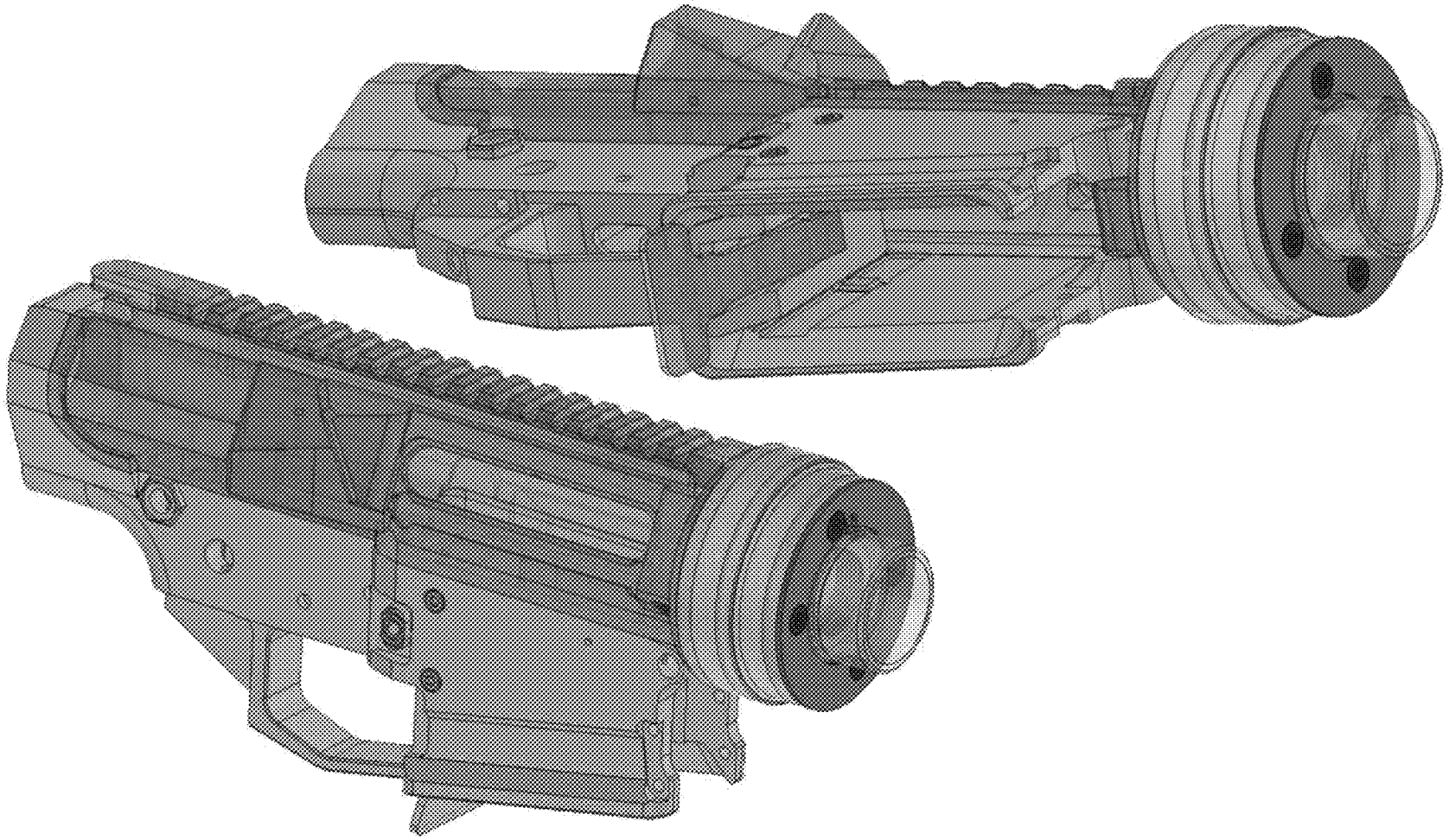

FIG. 19 shows a Multical Lower (AK47 Configuration); M4K Multical Lower (AK47 Configuration i.e., front wall is removed, AK mag block installed).

Figure 20:
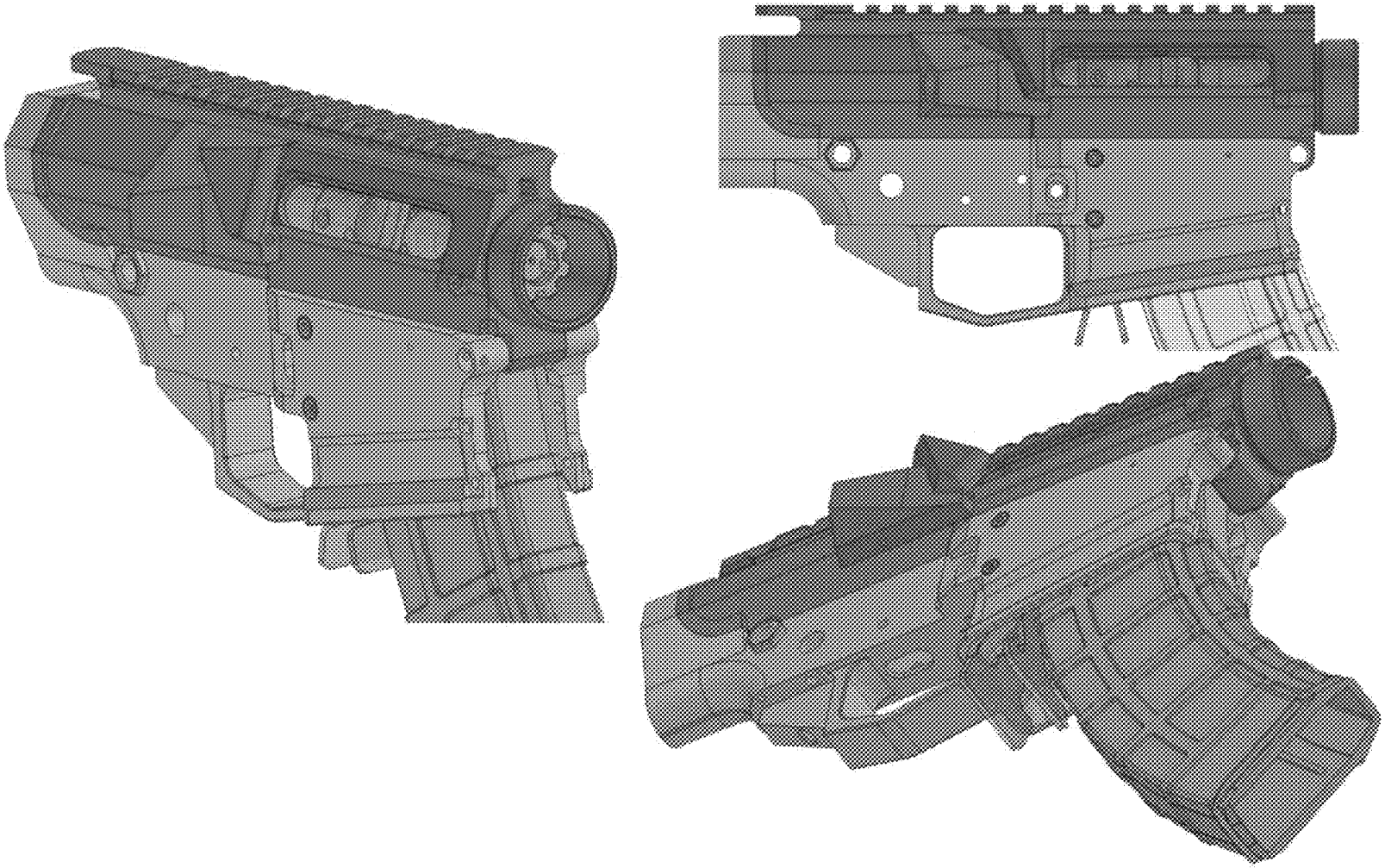

FIG. 20 shows a Multical Lower (AK47 Configuration); M4K Multical Lower (AK47 Configuration i.e., front wall is removed, AK mag block installed).

Figure 21:
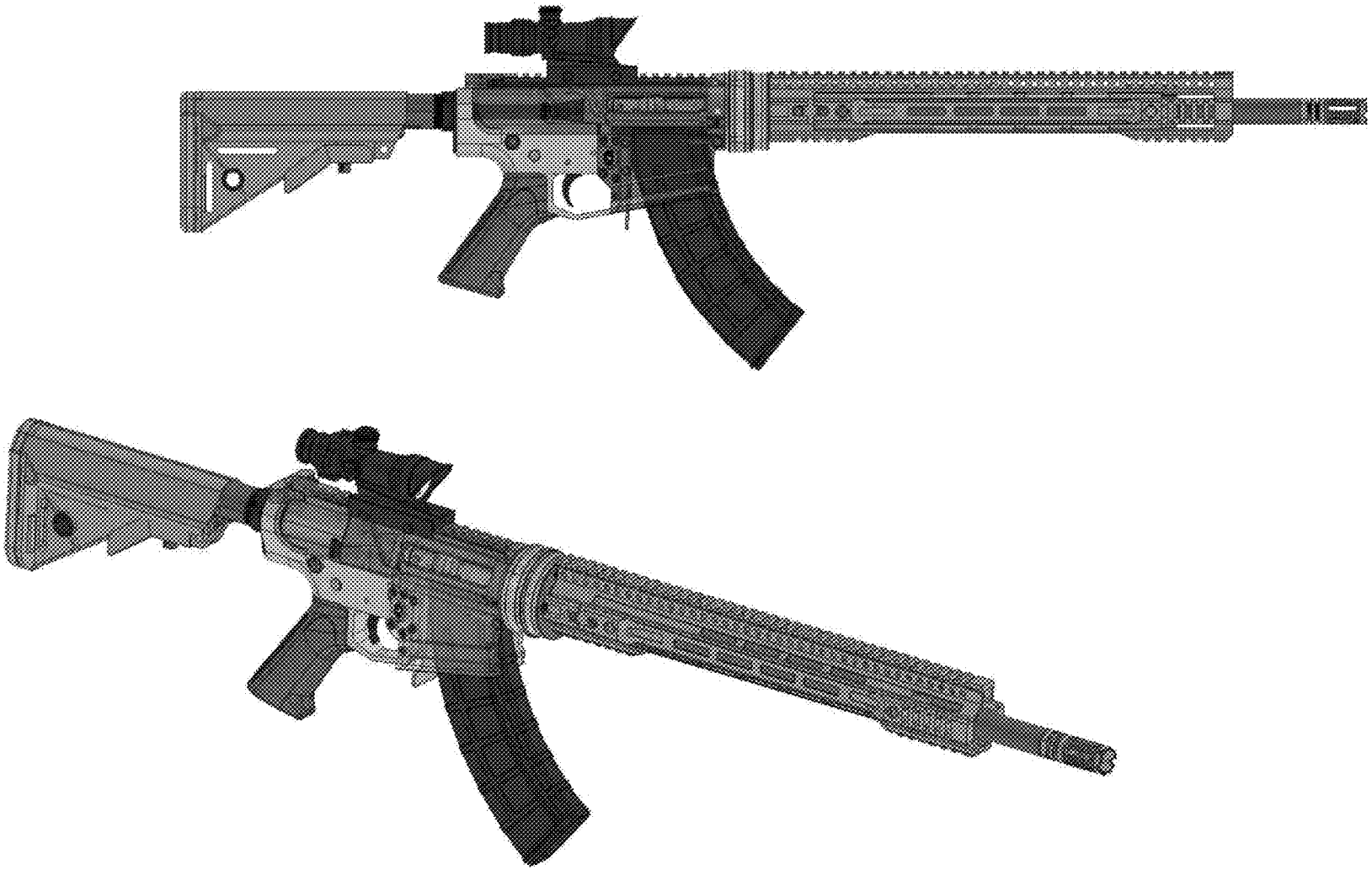

FIG. 21 shows a Multical Lower (AK47 Configuration).

Figure 22:
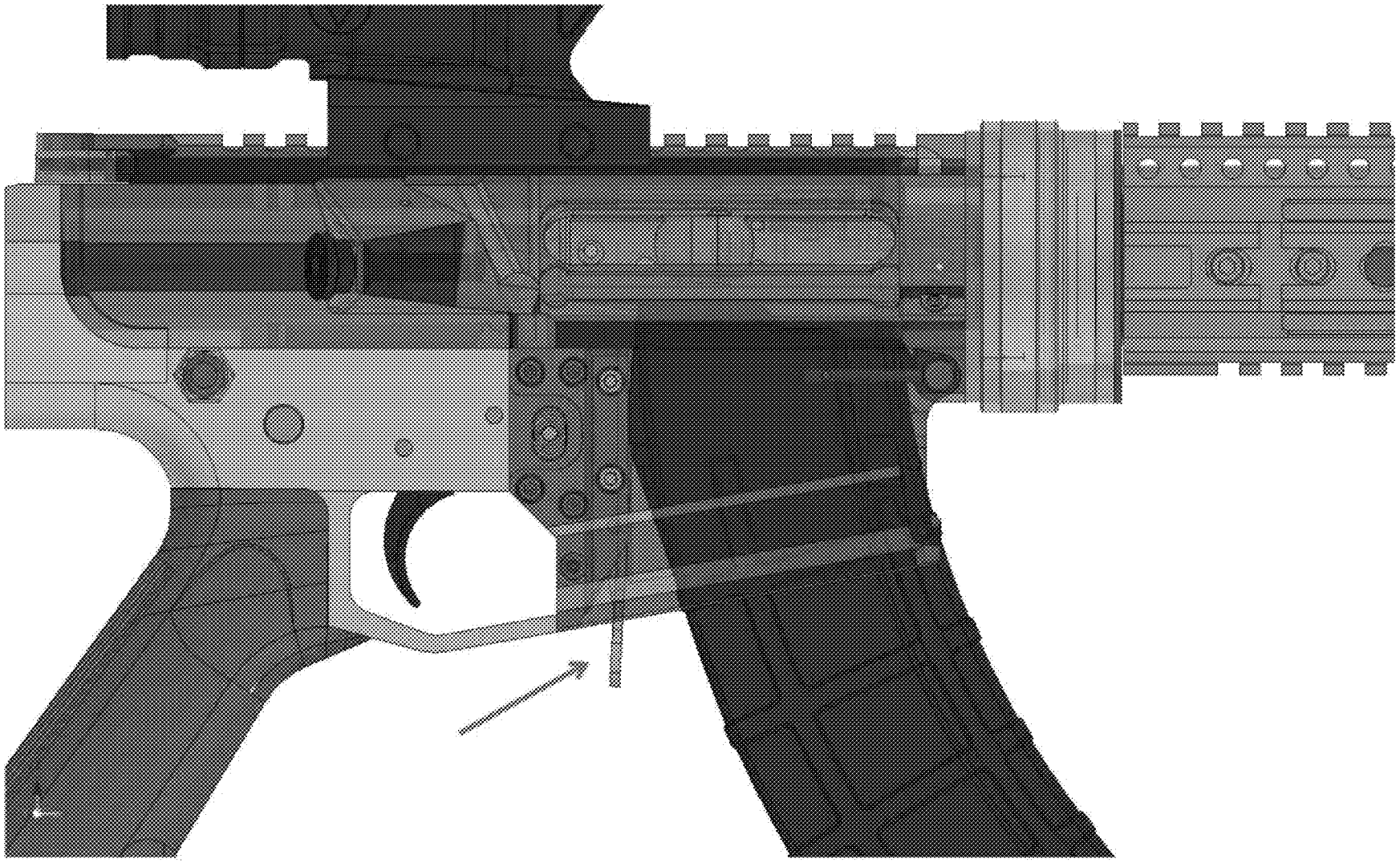

FIG. 22 shows a Multical Lower (AK47 Configuration) Mag captured by front tab and rear paddle in the same manner as current or standard AK variant rifles.

Figure 23:
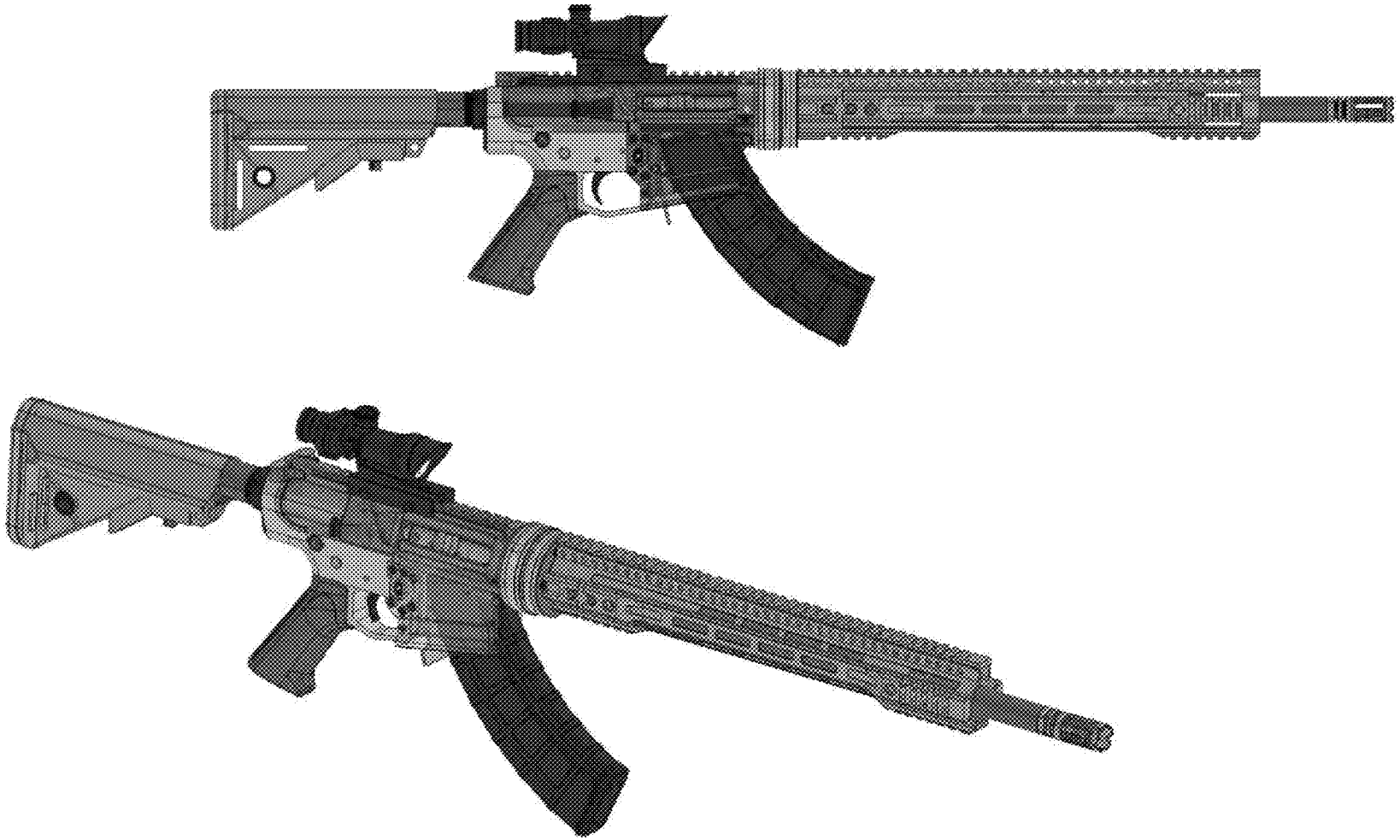

FIG. 23 shows a Multical Lower (AK47 Configuration).

Figure 24:
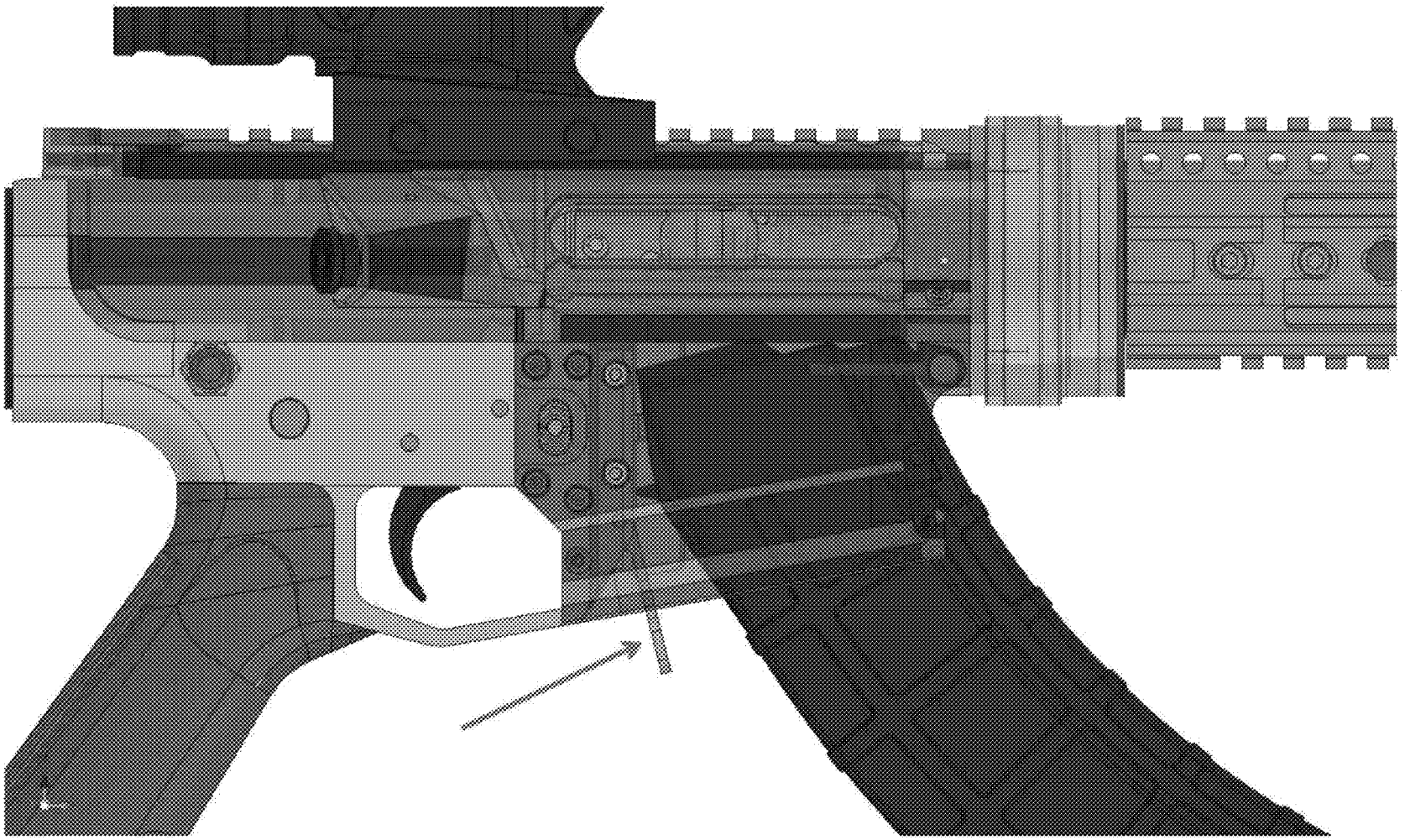

FIG. 24 shows a Multical Lower (AK47 Configuration). When paddle is pushed forward the magazine is able to tilt and release in the same manner as current or standard AK variant rifles.

Figure 25:
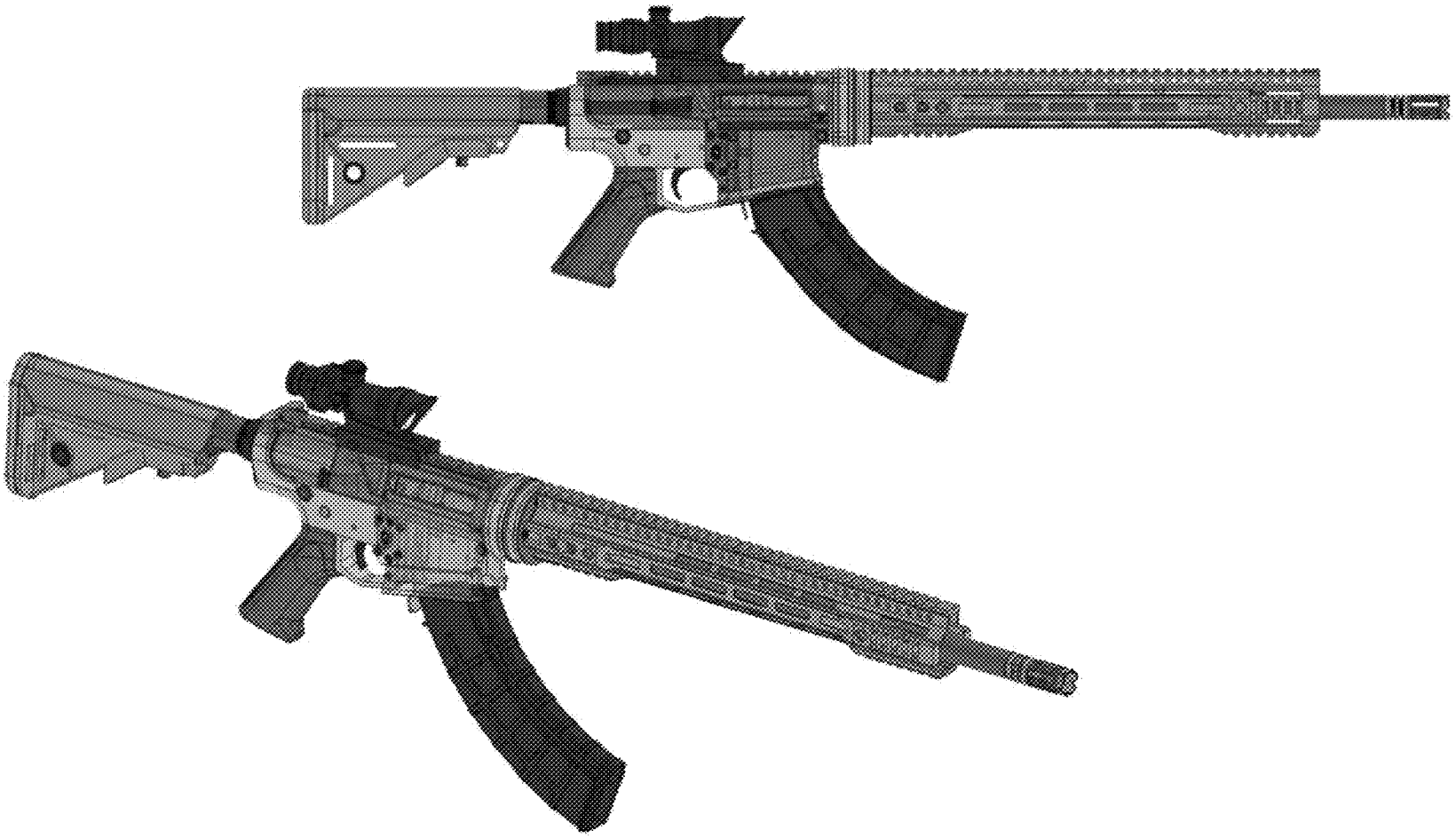

FIG. 25 shows a Multical Lower (AK47 Configuration). When paddle is pushed forward the magazine is able to tilt and release in the same manner as current or standard AK variant rifles.

Figure 26:
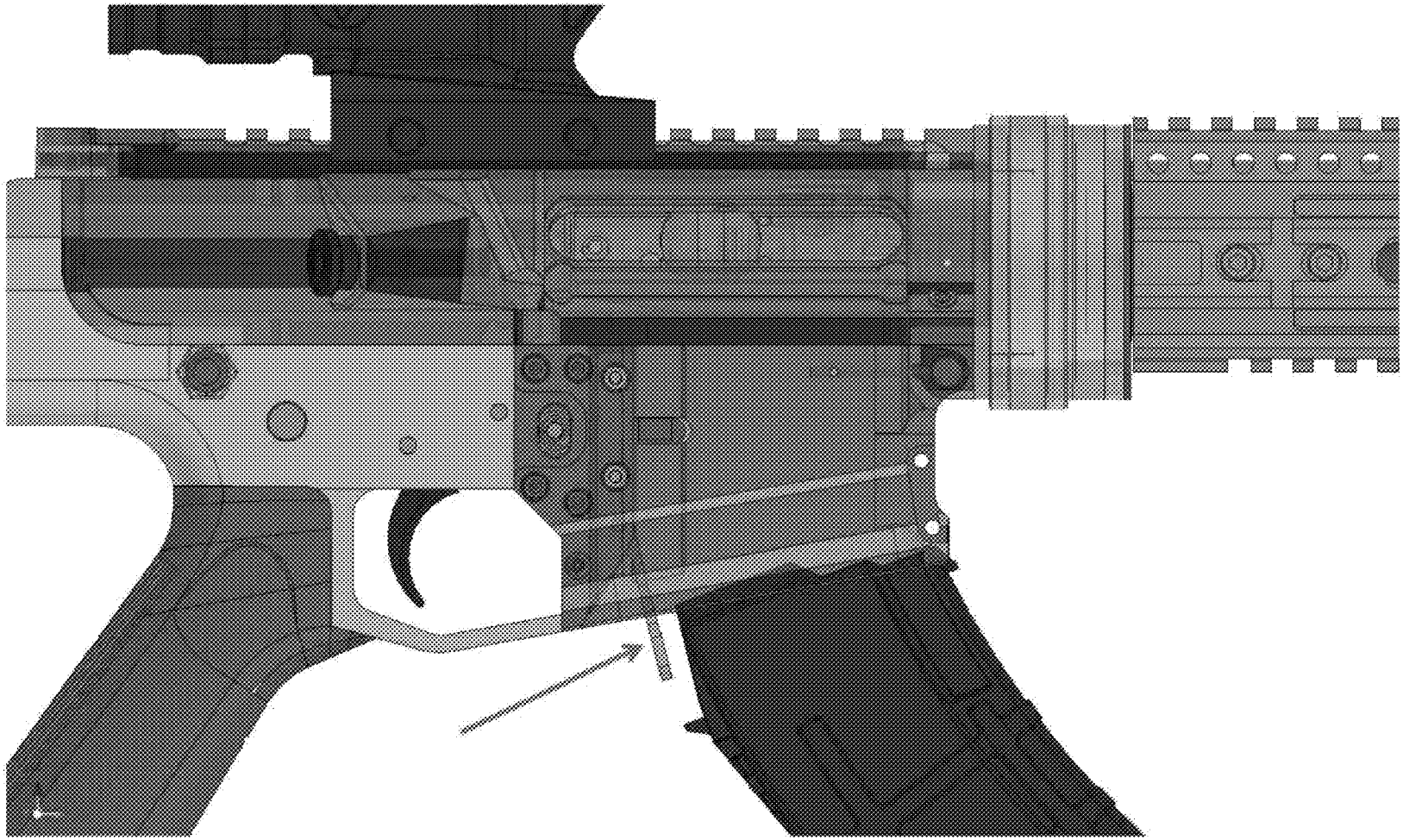

FIG. 26 shows a Multical Lower (AK47 Configuration). When paddle is pushed forward the magazine is able to tilt and release in the same manner as current or standard AK variant rifles.

Figure 27:
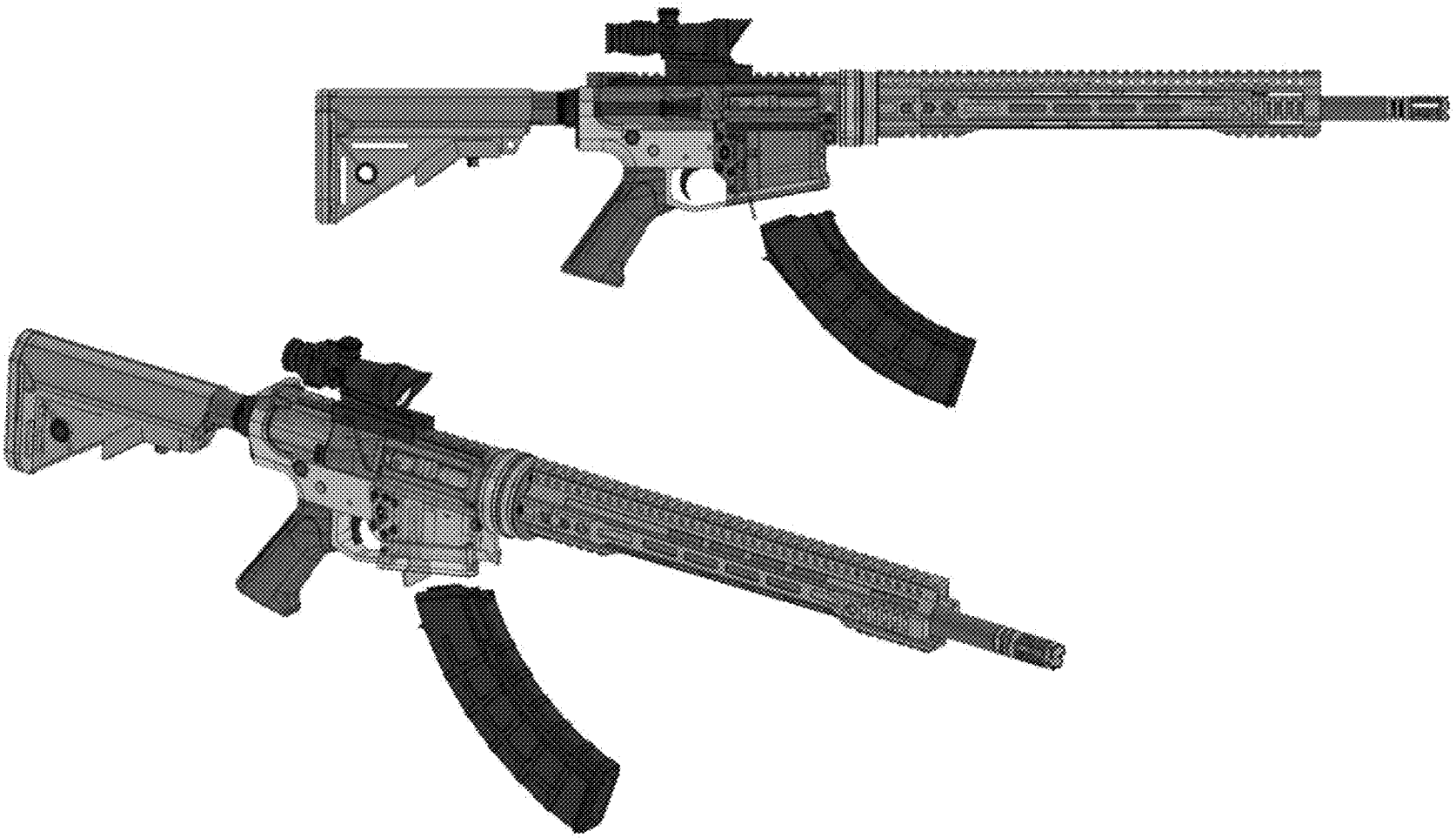

FIG. 27 shows a Multical Lower (AK47 Configuration). When paddle is pushed forward the magazine is able to tilt and release in the same manner as current or standard AK variant rifles.

Figure 28:
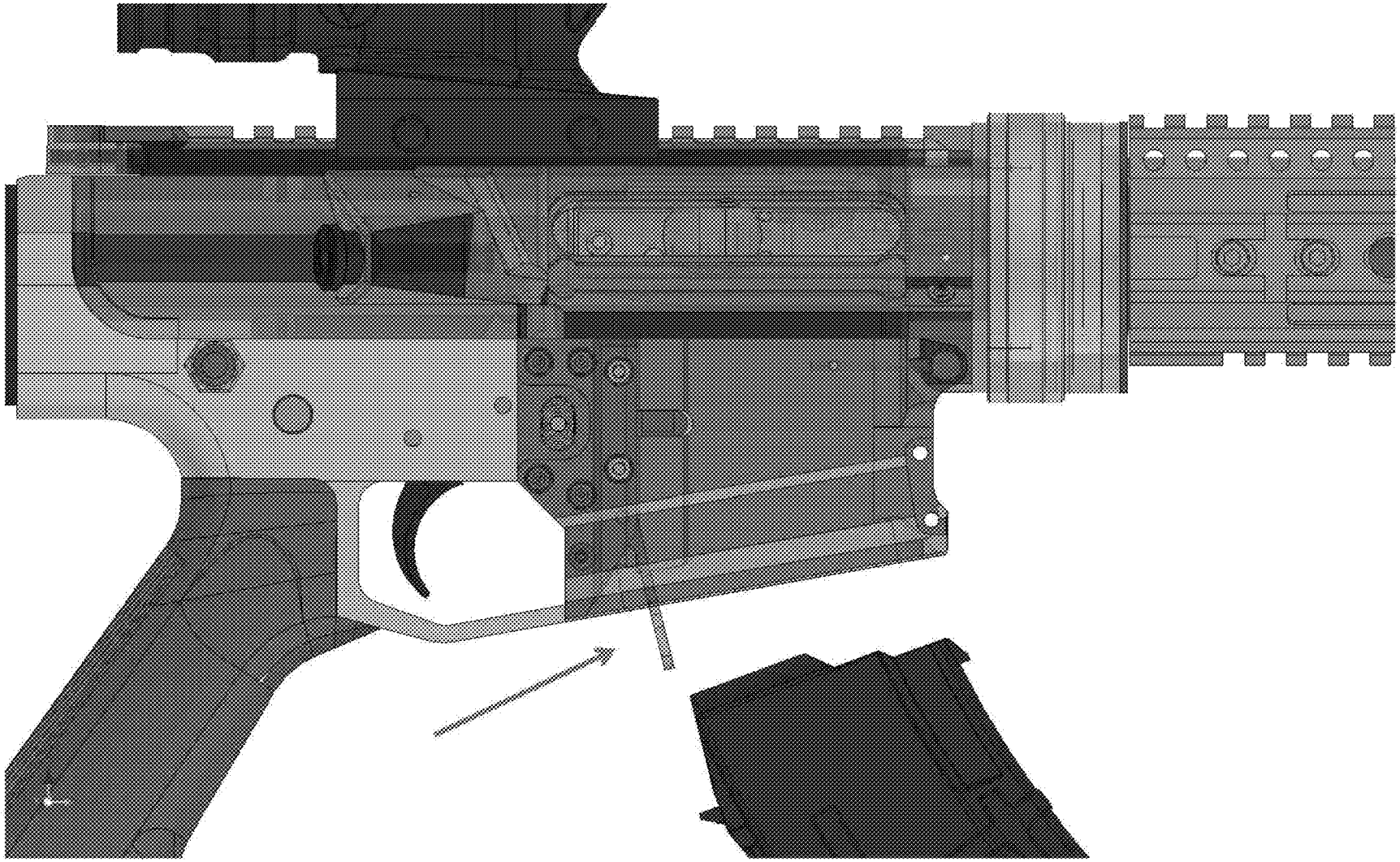

FIG. 28 shows a Multical Lower (AK47 Configuration). When paddle is pushed forward the magazine is able to tilt and release in the same manner as current or standard AK variant rifles.

Figure 29:
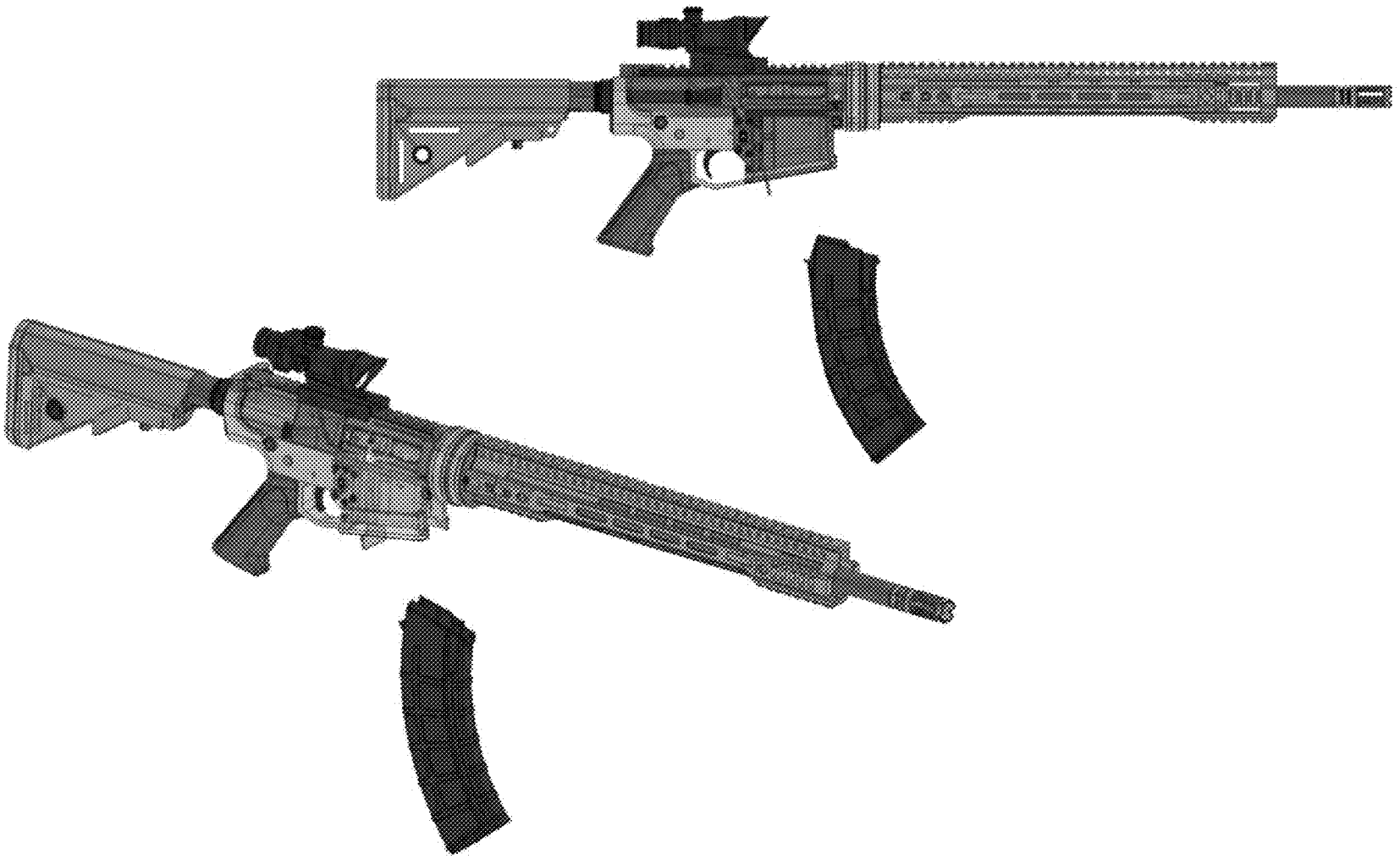

FIG. 29 shows a Multical Lower (AK47 Configuration). When paddle is pushed forward the magazine is able to tilt and release in the same manner as current or standard AK variant rifles.

Figure 30:
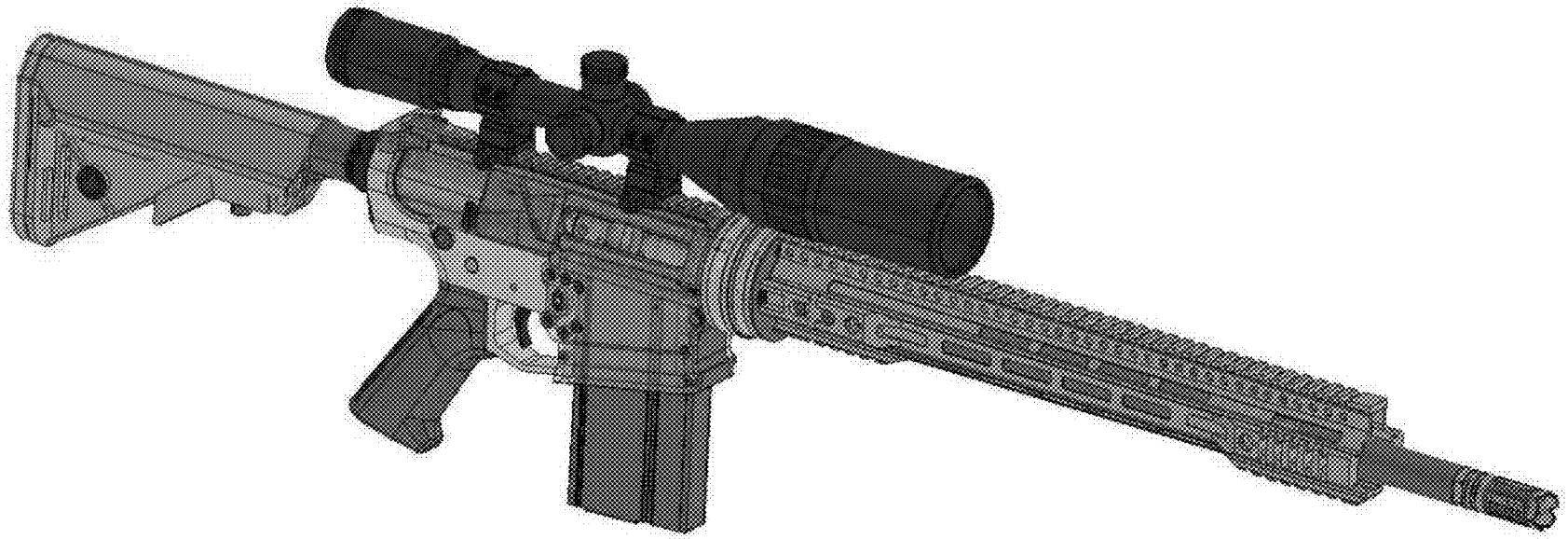

FIG. 30 shows a Multical Lower (76/65 Configuration).

Figure 31:
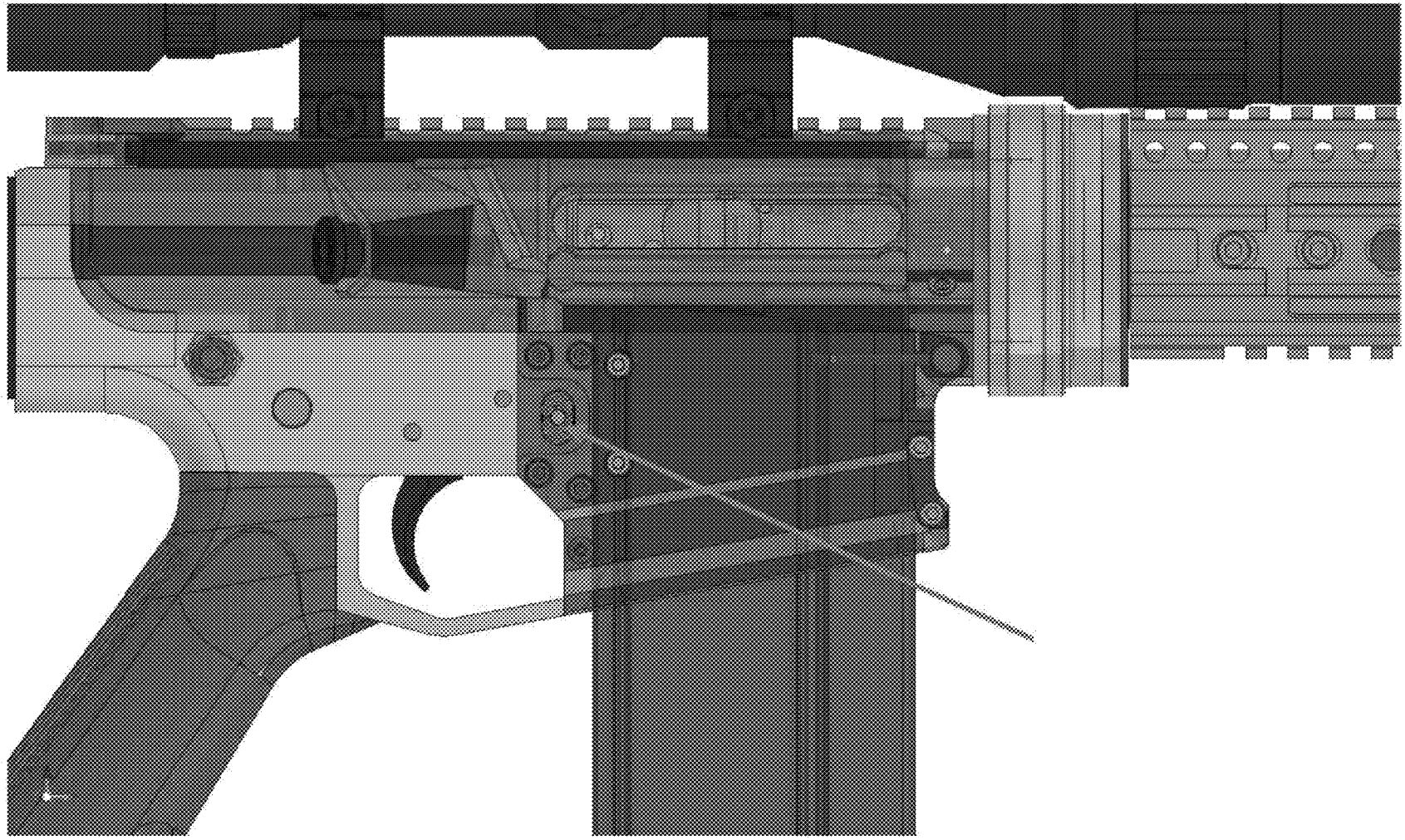

FIG. 31 shows a Multical Lower (76/65 Configuration). When standard magazine release button is pushed forward the magazine is able to drop free and release in the same manner as current or standard AR/M16 variant rifles.

Figure 32:
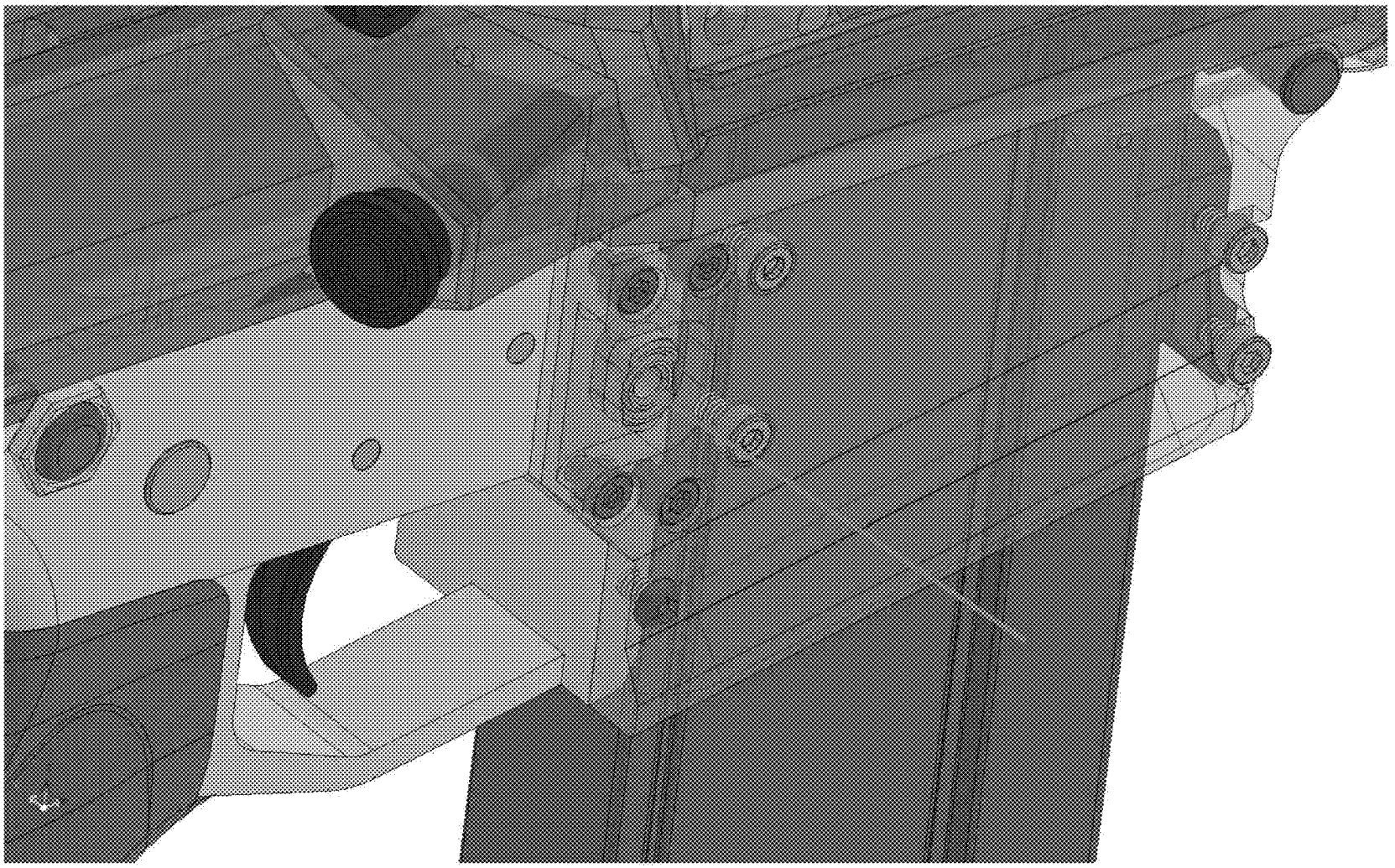

FIG. 32 shows a Multical Lower (76/65 Configuration). When standard magazine release button is pushed forward the magazine is able to drop free and release in the same manner as current or standard AR/M16 variant rifles.

Figure 33:
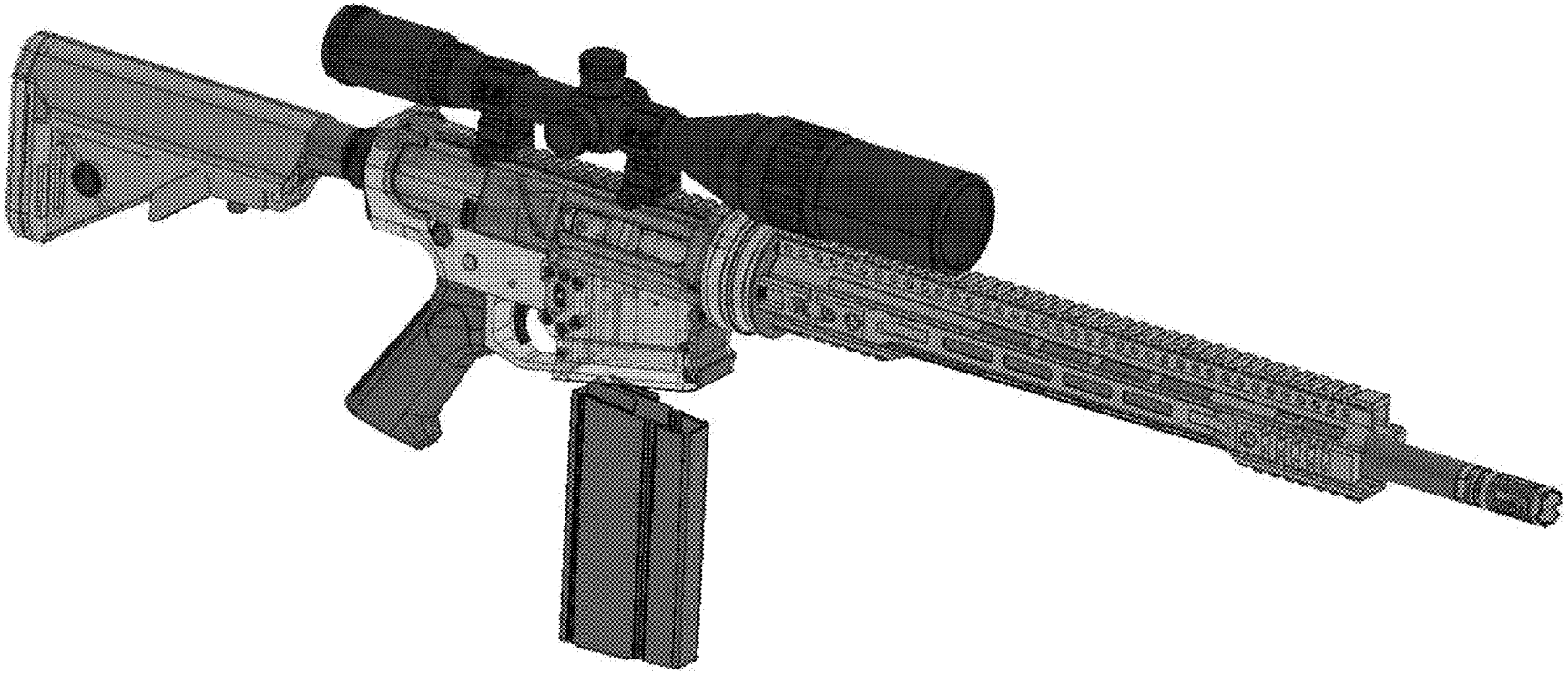

FIG. 33 shows a Multical Lower (76/65 Configuration). When standard magazine release button is pushed forward the magazine is able to drop free and release in the same manner as current or standard AR/M16 variant rifles.

Figure 34:
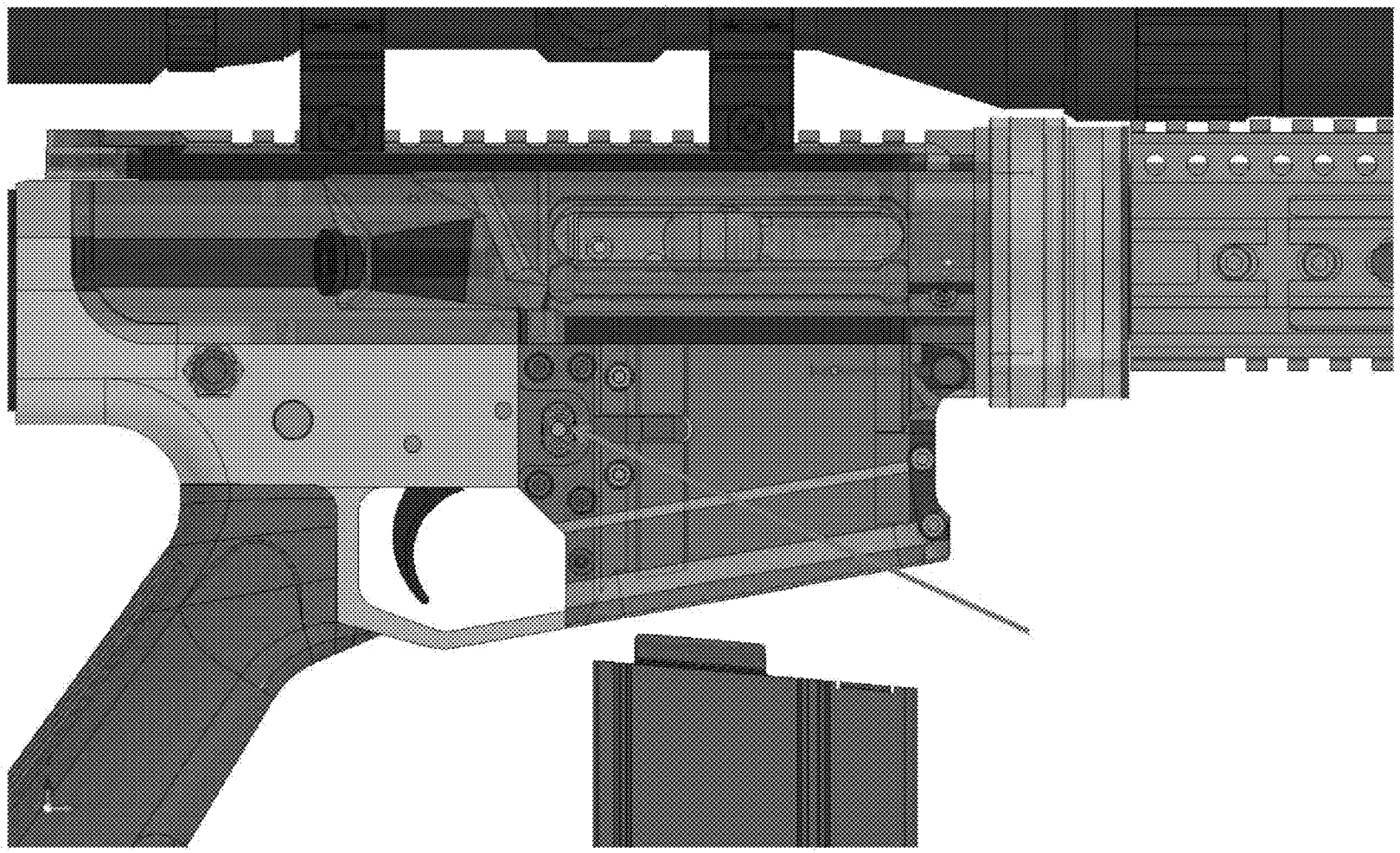

FIG. 34 shows a Multical Lower (76/65 Configuration). When standard magazine release button is pushed forward the magazine is able to drop free and release in the same manner as current or standard AR/M16 variant rifles.

Figure 35:
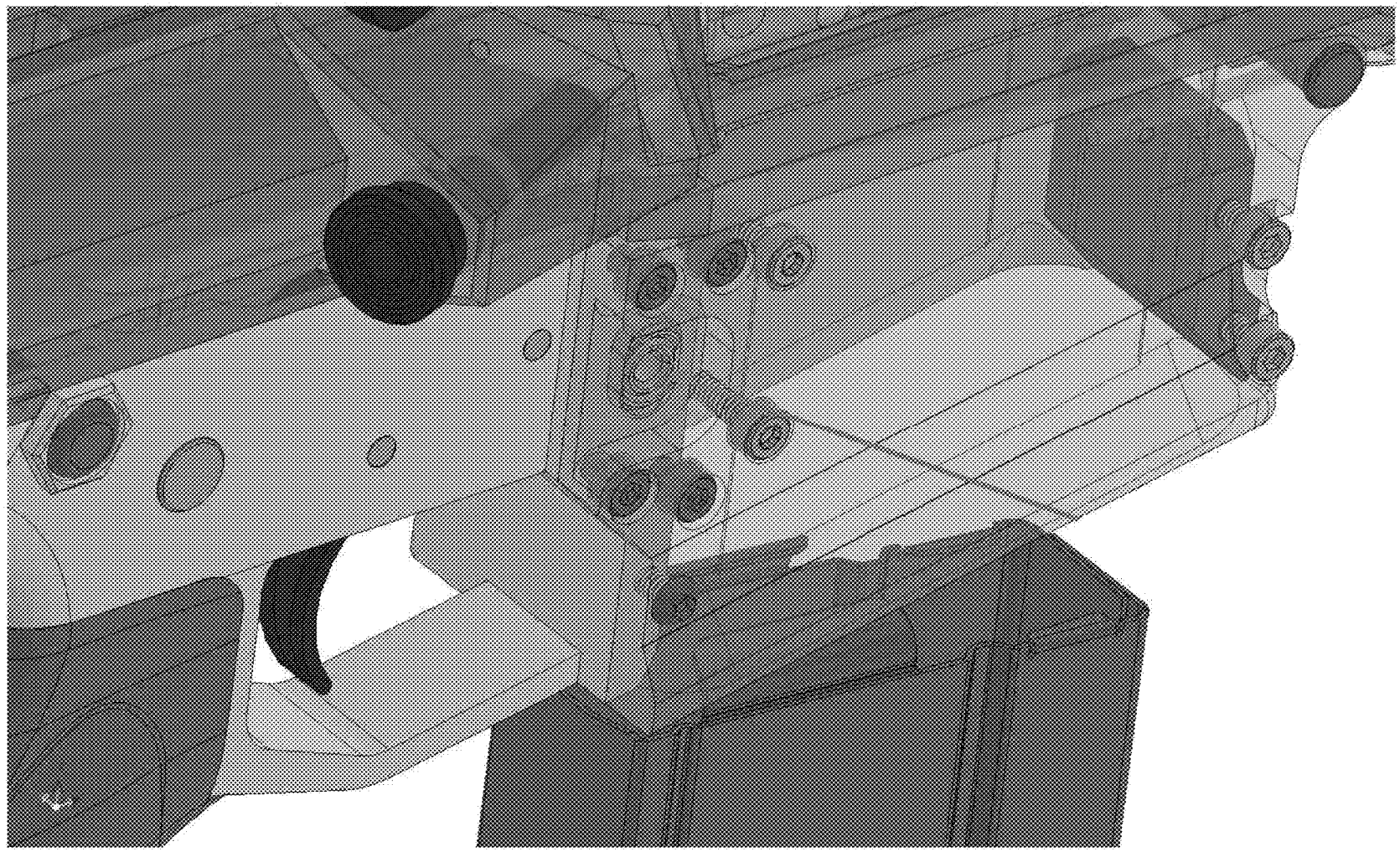

FIG. 35 shows a Multical Lower (76/65 Configuration). When standard magazine release button is pushed forward the magazine is able to drop free and release in the same manner as current or standard AR/M16 variant rifles.

Figure 36:
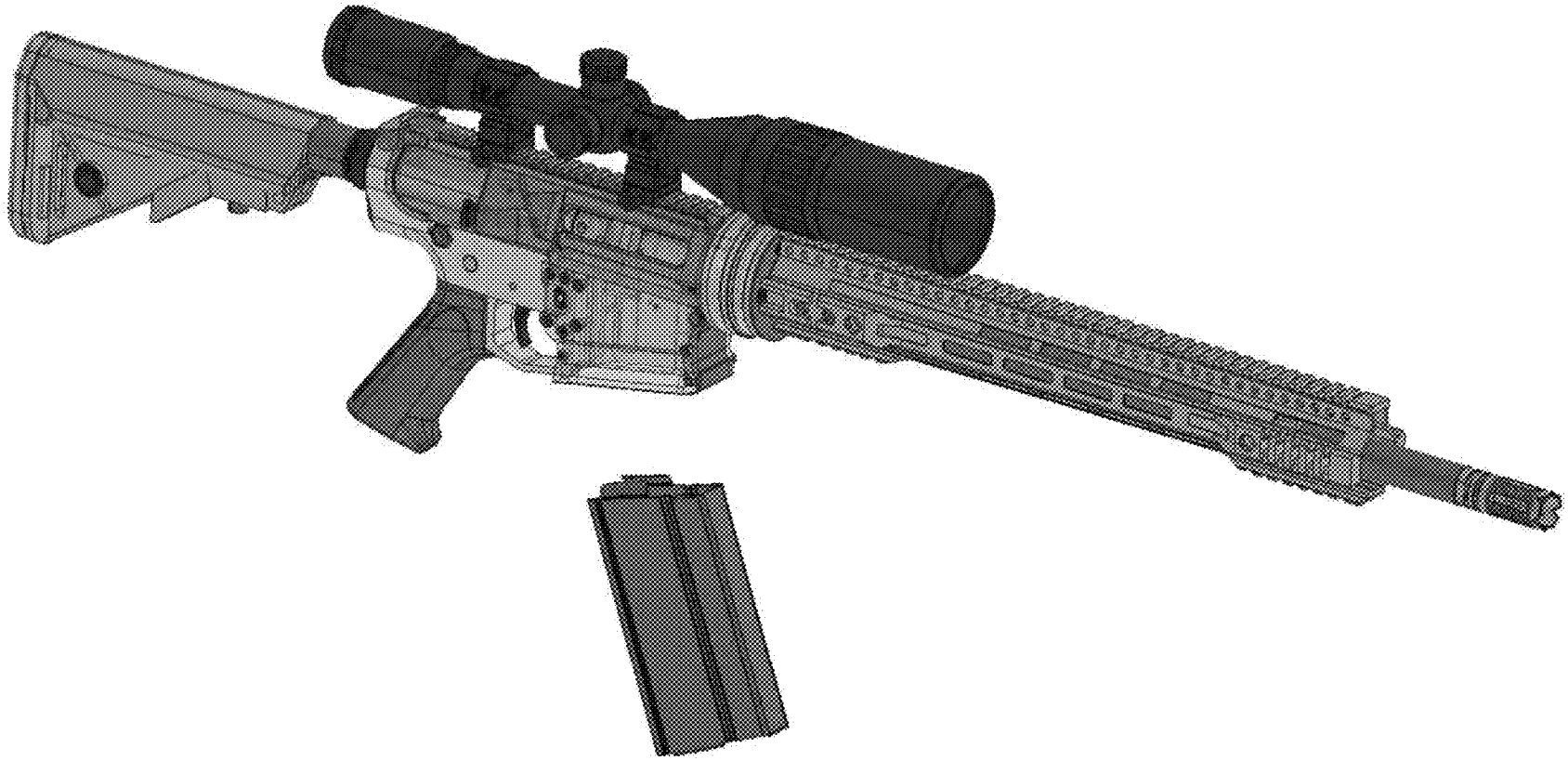

FIG. 36 shows a Multical Lower (76/65 Configuration). When standard magazine release button is pushed forward the magazine is able to drop free and release in the same manner as current or standard AR/M16 variant rifles.

This design is of a multi-caliber lower which is an AR10 platform rifle capable of firing the 7.62×51 round from a standard AR10 variant box magazine and is also capable of firing a 7.62×39 from an AK variant box magazine as well. This rifle variation would allow the AR10 variant box magazine to be loaded straight in and a tilt-in loading manipulation would allow an AK variant box magazine to also be used.

One of the variations (rear inserted block and paddle) allows the AK47 variant rifle box magazine to be loaded into the rifle by tilting it in. The tilt-in manipulation is the typical motion of the AK47 variant rifle loading procedure.

Removal of the rear inserted block and paddle allows the box magazine to be loaded straight in (i.e. functions in the same manner as the AR15/M16/AR10 platform).

The rear inserted block and paddle design will allow the rifle to both chamber and fire ammunition from the AK47 magazine. The method of reloading or inserting the AK47 magazine is a tilt in motion as performed on AK47 and AK47 variant rifles. Removal of the rear inserted block and paddle allows the magazine to drop free similar to the AR15/M16/AR10 rifle variations without any required rocking motion imparted by the user to extract the magazine from the rifle.

Multical lower is shown in a modular and one-piece configuration but the steps are the same. The multical lower in the one-piece configuration still has a removable front wall to allow AK style magazines but does not have a removable side wall on the magazine well. The modular multical lower has a removable sidewall which aids in future adaptations for a slide in or detachable magazine well which is still in development but satisfies our goal of a multi caliber lower capable of firing a wide range of ammunition caliber ranges as well as accepts a wide range of magazine types and styles.

The complete Multical lower consists of the following components:

Multical Lower,

Front magazine wall;

AK mag block adapter; and

Modular side wall installation and removal (where applicable on future options currently in development).

I claim:

1. A firearm comprising:

a body having a trigger guard and defining a magazine well;

the well having a rear wall and a first side wall integrated with the body;

a front wall detachable from the body and from the trigger guard and in part defining the magazine well; and a second side wall detachable from the body and from the front wall, and in part defining the magazine well.

* * * * *